US008043195B2

(12) United States Patent
Cunningham

(10) Patent No.: US 8,043,195 B2
(45) Date of Patent: Oct. 25, 2011

(54) EXERCISE APPARATUS

(75) Inventor: Thomas Cunningham, Lexington, KY (US)

(73) Assignee: TC Motions, Inc, Atlanta, GA (US)

( * ) Notice: Subject to any disclaimer, the term of this patent is extended or adjusted under 35 U.S.C. 154(b) by 0 days.

(21) Appl. No.: 12/801,044

(22) Filed: May 19, 2010

(65) Prior Publication Data

US 2010/0227739 A1 Sep. 9, 2010

Related U.S. Application Data

(63) Continuation of application No. 11/730,662, filed on Apr. 3, 2007, now Pat. No. 7,744,507.

(60) Provisional application No. 60/789,373, filed on Apr. 5, 2006.

(51) Int. Cl.
*A63B 22/00* (2006.01)

(52) U.S. Cl. ..... 482/51; 482/56; 482/70

(58) Field of Classification Search ..... 482/51, 482/56, 70–71, 92, 131, 133, 135
See application file for complete search history.

(56) References Cited

U.S. PATENT DOCUMENTS

| | | | | |
|---|---|---|---|---|
| 219,439 | A | 9/1879 | Blend | |
| 2,019,224 | A | 10/1935 | Hess | |
| 2,013,520 | A | 9/1938 | McDermott | |
| 2,953,394 | A * | 9/1960 | Anderson | 280/207 |
| 3,627,315 | A | 12/1971 | Marcyan | |
| 3,791,646 | A | 2/1974 | Marchignoni | |
| 4,468,026 | A | 8/1984 | Roark | |
| 4,765,315 | A | 8/1988 | Krukowski | |
| 4,781,372 | A | 11/1988 | McCormack | |
| 4,915,373 | A | 4/1990 | Walker | |
| 4,927,136 | A | 5/1990 | Leask | |
| 5,015,926 | A | 5/1991 | Casler | |
| 5,102,122 | A * | 4/1992 | Piane et al. | 482/133 |
| 5,180,351 | A | 1/1993 | Ehrenfried | |
| 5,514,053 | A | 5/1996 | Hawkins et al. | |
| 5,575,740 | A | 11/1996 | Piaget et al. | |
| 5,683,330 | A | 11/1997 | Kobayashi | |
| 5,792,028 | A | 8/1998 | Jarvie | |

(Continued)

OTHER PUBLICATIONS

Aagaard, P., et al., "A New Concept for Isokinetic Hamstring: Quadriceps Muscle Strength Ratio.", The American Journal of Sports Medicine, 1998, 26(2): p. 231-7.

(Continued)

*Primary Examiner* — Glenn Richman
(74) *Attorney, Agent, or Firm* — Welsh Flaxman & Gitler LLC

(57) ABSTRACT

An exercise apparatus includes a support frame upon which is mounted a curvilinear track, the curvilinear track substantially conforming to a runner's footpath while striding. A first foot engaging support is secured to the curvilinear track for movement thereabout while exercising in accordance with the present invention. A resistance assembly is secured to the foot engaging support for applying resistance as a user moves the foot engaging support about the curvilinear track. A slide including a curvilinear carriage rides upon the curvilinear track and a first user engaging support is coupled to the slide for movement about the curvilinear track. A linear carriage rides upon a linear carriage rail supported by the support frame and a resistance assembly is coupled to the linear carriage. A slide bar links the curvilinear carriage of the slide to the linear carriage for the application of resistance as the user engaging support is moved about the curvilinear track.

18 Claims, 20 Drawing Sheets

U.S. PATENT DOCUMENTS

| | | | | |
|---|---|---|---|---|
| 5,855,538 | A * | 1/1999 | Argabright | 482/70 |
| 5,857,940 | A | 1/1999 | Husted | |
| 5,876,308 | A | 3/1999 | Jarvie | |
| 5,911,650 | A | 6/1999 | Cox | |
| 5,941,804 | A | 8/1999 | Johnston | |
| 6,042,511 | A | 3/2000 | Bulloch | |
| D425,585 | S * | 5/2000 | Wu | D21/676 |
| 6,063,008 | A | 5/2000 | McBride et al. | |
| 6,135,928 | A | 10/2000 | Butterfield | |
| 6,196,954 | B1 * | 3/2001 | Chen | 482/131 |
| 6,551,218 | B2 | 4/2003 | Goh | |
| 6,623,406 | B2 | 9/2003 | Wu | |
| 6,679,812 | B2 | 1/2004 | Torkelson | |
| 6,740,009 | B1 | 5/2004 | Hall | |
| 6,786,850 | B2 | 9/2004 | Nizamuddin | |
| 6,790,164 | B1 | 9/2004 | Davis | |
| 6,923,748 | B1 | 8/2005 | Mauz et al. | |
| 7,014,595 | B2 | 3/2006 | Bruno | |
| 7,052,439 | B2 | 5/2006 | Anderson et al. | |
| 7,556,592 | B2 * | 7/2009 | Nizam | 482/70 |
| 2001/0012811 | A1 | 8/2001 | Gordon | |
| 2004/0092368 | A1 | 5/2004 | Gramaccioni | |
| 2006/0128537 | A1 | 6/2006 | Philips | |
| 2006/0189454 | A1 | 8/2006 | Bull | |
| 2006/0223678 | A1 | 10/2006 | MacLean | |
| 2006/0287168 | A1 | 12/2006 | Nizam | |

OTHER PUBLICATIONS

Agre, J.C., "Hamstring Injuries: Proposed Aetiological Factors, Prevention, and Treatment", Sports Medicine, 1985, 2: p. 21-33.

Armstrong, L.E., et al., "Biomechanical Comparison of University Sprinters and Marathon Runners", Track Technique, 1984, 87: p. 2871-2782.

Babel, K., et al., "Influence of Ethnic Origin on Predictive Parameters of Performance in Sprint Running . . . ", International Journal of Sports Medicine, 2005, 26: p. 798-802.

Bennell, K., et al., "Does the Toe-Touch Test Predict Hamstring Injury in Australian Rules Footballers?", Australian Journal of Physiotherapy, 1999, 45: p. 103-109.

Bennell, K., et al., "Isokinetic Strength Testing Does Not Predict Hamstring Injury in Australian Rules Footballers", British Journal of Sports Medicine, 1998, 32: p. 309-314.

Burkett L.N., "Causative Factors in Hamstring Strains", Medicine & Science in Sports, 1970, 2(1): p. 39-42.

Cameron M., et al., "Motor Control and Strength as Predictors of Hamstring Injury in Elite Players of Australian Football", Physical Therapy in Sport, 2003, 4: p. 159-166.

Cavanagh, P.R., "Biomechanics of Distance Running" (Illinois: Human Kinetics Books 1990).

Coole, Jr., W.G., "An Analysis of Hamstring Strains and Their Rehabilitation", The Journal of Orthopaedic and Sports Physical Therapy, 1987, 9(2): p. 77-84.

Dauty, M., et al., "Consequences and Prediction of Hamstring Muscle Injury With Concentric . . . " Translated. Annales De Readaption Et De Medecine Physique, 2003, 46(9): p. 60.

Dillman, C.J., "Kinematic Analyses of Running", Exercise Sport Science Reviewship, 1975, p. 193-216.

Drezner, J.A., "Practical Management: Hamstring Muscle Injuries", Clinical Journal of Sport Medicine, 2003 13: p. 48-52.

Elliot, B.C., et al., "A Cinematographic Analysis of Overground and Treadmill Running by Males and Females", Medicine and Science in Sports, 1976, 8(2): p. 84-87.

Foreman, T.K., et al., "Prospective Studies into the Causation of Hamstring Injuries in Sport: A Systematic Review", Physical Therapy in Sport, 2006, 7: p. 101-109.

Garrett, Jr., W.E., "Muscle Strain Injuries", American Journal of Sports Medicine, 1996, 24(S2-S8).

Garrett, Jr., W.E., "Muscle Strain Injuries: Clinical and Basic Aspects", Medicine and Science in Sports and Exercise, 1990, 22: p. 436-443.

Heiderscheit, B. C., et al., "Identifying the Time of Occurance of a Hamstring Strain Injury During Treadmill Running . . . ", Clinical Biomechanics, 2005, 20: p. 1072-1078.

Hewett, T. E.,et al., "Biomechanical Measures of Neuromuscular Control and Valgus Loading of the Knee . . . ", The American Journal of Sports Medicine, 2004, 33(4) : p. 492-501.

Hewett, T. E.,et al., "Plyometric Training in Female Athletes, Decreased Impact Forces and Increased Hamstring . . . " American Journal of Sports Medicine, 1996, 24: Abstract.

Hoshikawa, T., et al, "Analysis of Running Pattern in Relation to Speed", Medicine and Sport, 1973, 8: p. 342-348.

Ivanenko, Y.P., et al., "Control of Foot Trajectory in Human Locomotion: Role of Ground Contact Forces . . . " Journal of Neurophysiology, 2002, 87: p. 3070-3089.

Kaminski, T.W., et al., "Concentric Versus Enhanced Eccentric Hamstring Strength Training: Clinical Implications", Journal of Athletic Training, 1998, 33(3): p. 216-221.

Koulouris, G., et al., "Evaluation of the Hamstring Muscle Complex Following Acute Injury." Skeletal Radiology, 2003, 32: p. 582-589.

Kubukeli, Z., et al. "Training Techniques to Improve Endurance Exercise Performances." Sports Medicine, 2002, 32(8): p. 489-509.

Lephart, S.M., et al., "Functional Rehabilitation for the Upper and Lower Extremity", Orthopedic Clinics of North America, 1995, 26(3): p. 579-92.

Mah, C., et al., "Quantitative Analysis of Human Movement Synergies: Constructive Pattern Analysis for Gait." Journal of Motor Behavior, 1994, 26(2): Abstract.

Mann, R. et al., "A Kinetic Analysis of the Ground Leg During Sprint Running", Res.Q. Exercise and Sport, 1980, 51: p. 334-348.

Miller, D.I., "Biomechanics of Running—What Should the Future Hold?", Canadian Journal of Applied Sports Sciences, 1978, 3: p. 229-236.

Novacheck, T.F., "The Biomechanics of Running", Gait and Posture, 1998, 7: p. 77-95.

Noyes, F.R., et al., "A Rationale for Assessing Sports Activity Levels and Limitations in Knee Disorders", Clinical Orthopedics, 1989, 246: p. 238-249.

Orchard, J., "Biomechanics of Muscle Strain Injury." Journal of Sports Medicine, 2002, 30: p. 92-98.

Orchard, J. et al., "Preseason Hamstring Muscle Weakness Associated with Hamstring Muscle Injury in . . . ", The American Journal of Sports Medicine, 1997, 25(1): p. 81-85.

Patton, J. L., et al., "Robot-Assisted Adaptive Training: Custom Force Fields for Teaching . . . " IEEE Transactions on Biomedical Engineering, 2004, 51(4): p. 636-646.

Ross, A., et al., "Neural Influences on Sprint Running, Training Adaptions and Acute Responses", Sports Medicine, 2001, 31(6): p. 409-425.

Sale, D., et al., "Specificity in Strength Training: A Review for the Coach and Athlete", Canadian Journal of Applied Sports Sciences, 1981: p. 87-92.

Seward, H., et al., "Epidemiology of Injuries in the Australian Football League, Seasons 1997-2000", British Journal of Sports Medicine, 2002, 36: p. 39-45.

Sinning, W.E., et al., "Lower-Limb Actions While Running at Different Velocities", Medicine and Science in Sport, 1970, 2(1): p. 28-34.

Straub, T., et al., "Acute Anterior Cruciate Ligament Repair", Clinical Orthopedics, 1988, 227: p. 238-250.

Thelen, D.G., et al., "Hamstring Muscle Kinematics During Treadmill Sprinting", Medicine & Science in Sports & Exercise, 2005: p. 108-114.

Weyand, P.G., et al., "Faster Top Running Speeds are Achieved with Greater Ground Forces Not More Rapid Leg Movement", Journal of Applied Physiology, 2000, 89: p. 1991-1999.

Williams, K.R., "Biomechanics of Running", Exercise Sport Science Reviews, 1985, p. 389-441.

Woods, C., et al., ". . . An Audit of Injuries in the Professional Football—Analysis of Hamstring Injuries", British Journal of Sports Medicine, 2004, 38: p. 36-41.

Woods, C., et al., ". . . An Audit of Injuries in Professional Football—Analysis of Preseason Injuries", British Journal of Sports Medicine, 2002, 36: p. 436-441.

Worrell, T.W., "Factors Associated with Hamstring Injuries: An Approach to Treatment and Preventative Measures", Journal of Sports Medicine, 1994, 17(5): p. 338-345.

* cited by examiner

LFS - left footstrike
LTO - left toe-off
RFS - right footstrike
RTO - right toe-off

EXERCISE APPARATUS

CROSS REFERENCE TO RELATED APPLICATIONS

This application is a continuation of U.S. patent application Ser. No. 11/730,662, filed Apr. 3, 2007, now U.S. Pat. No. 7,744,507, entitled "EXERCISE APPARATUS", which claims the benefit of U.S. Provisional Patent Application Ser. No. 60/789,373, filed Apr. 5, 2006, entitled "INJURY PREVENTION AND REHABILITATION MACHINE FOR THE LEG MUSCLES VIA RESISTANCE DURING A FUNCTIONAL MOVEMENT".

BACKGROUND OF THE INVENTION

1. Field of the Invention

The invention relates an exercise apparatus. More particularly, the invention relates to an exercise apparatus adapted for exercising the hamstring of an individual in an efficient and effective manner. The exercise apparatus is particularly adapted for facilitating strength training, injury prevention and/or rehabilitation for leg muscles.

2. Description of the Related Art

Running, or in particular sprinting, is a very common component of nearly every competitive and recreational sport. The ability to run, or sprint is a skill that is enhanced with training many systems, mental, cardiovascular, neuromuscular, and musculoskeletal. Competitive and recreational athletes with better ability to sprint or those that can sprint more often in their respective sport are rewarded in accolades and in professional sports financially. Therefore, this ability is important to train.

A method of training that has become popular amongst coaches and trainers is to functionally train individuals in a manner that is specific to their respective sport opposed to isolating muscles involved in that sport. This concept of training in a similar manner to how you will compete is intuitive but is easier said than done. Creative exercises have been developed and implemented into exercise regimens that mimic certain functional tasks demanded by the desired activity or sport such as pulling a runner to supra-maximal speeds during training for track. Fundamentally similar training methods which focus on specificity training have shown positive but limited results of improved performance in the execution of these functional tasks and the potential to reduce injuries particular to movements commonly practiced in a respective sport.

With running being of particular interest, it should be mentioned that hamstring injuries have been identified as some of the most common injuries to occur in sports requiring significant running and sprinting activities such as soccer, Australian rules football, American football and track. A study of English professional football (soccer) has shown that hamstring injuries account for 12-15% of all injuries sustained. The English premier football league reported a gross revenue of close to $3.8 billion in the 1999-2000 season with injuries alone costing as much as $144.7 million. Hamstring injuries are common occurrences in athletes and currently there is not a clear understanding of what factors predict this type of injury. Muscle strength, flexibility, fatigue, and neuromuscular control are some of the most common factors commonly thought to be associated with hamstring injuries. Additionally, these factors are critical components in enhancing sprint performance through sports specific exercises. Measures need to be taken in order to further understand hamstring injuries with the goal of reducing the amount of hamstring injuries occurring each year. The scientific literature is constantly evaluating exercise interventions that can be utilized both in the prevention and rehabilitation of injuries and performance enhancement.

Experts have determined the hamstring is best developed when worked in a similar motion to when it is mostly stressed. The motion in which the hamstring is stressed the most is during the running motion and unsurprisingly the majority of injuries to the hamstrings occur during the running motion.

Just having the hamstring lifting weight in a free weight motion is not optimal for training the hamstring. This motion does make your hamstrings stronger but what experts have agreed upon is that this type of strength training is secondary when performance, injury prevention and rehabilitation factors are considered. The hamstrings are rated, as well as other body parts, on how much power they are able to generate, not necessarily on how strong they are, i.e., not how much dead weight they can lift from a stationary position but how fast and often they can lift that weight. The relationship between strength and power is usually positively/directly related but the strongest people do not necessarily produce the most power. For example, Michael Jordan has one of the highest vertical jumps in basketball. He, however, might be weaker than the majority of NBA players according to how much weight he can lift with his legs.

The ideal method for developing power for a certain human motion is to work those muscles involved in the motion using the same motion you are trying to make stronger. Using a rough example, if you want to jump higher, add weights on your shoulders and start jumping. This same method holds true for your hamstrings and running. A way to accomplish this is to add resistance to the leg while the leg is in a running motion. While working the hamstring as weight is increased, the speed of the leg decreases. As it eventually becomes stronger, it will gain speed until the weighted leg moves just as fast as the original non-resisted leg. Once this is accomplished, it is then time to add weight. This process can be iterated indefinitely but the output will follow a steep production curve.

To avoid confusion some terms and phrases used throughout the present disclosure should be defined. It is recognized that there is currently debate when defining the differences among walking, running and sprinting. For the purposes of the present disclosure these terms have been defined based on the desired outcome of the individual while not ignoring mandatory mechanical characteristics seen at each respective speed category.

- Stride: One gait cycle which begins when one foot strikes the ground and ends when the same foot strikes the ground again. (ipsilateral to ipsilateral foot strike)
- Stance Phase: Phase of gait when the foot is in contact with the ground
- Swing Phase: Phase of gait when the foot is not in contact with the ground.
- Walking: Has two periods of double support in each gait cycle, meaning that both feet are in contact with the ground simultaneously.
- Running: Has a period of double float (no foot is on the ground) with foot contact being near the rear or midfoot. Energy is conserved during this movement.
- Sprinting: Like running, also has a period of double float but the goal is to move the limbs as fast as possible with no regard to aerobic cost. Foot strike is at the forefront of the foot.

Despite the high instances of hamstring injuries, the exact cause and timing is still unknown. There are two prevailing theories that exist as to the phase of gait in which hamstring strains occur. The first theory states that the late swing and early stance phases of sprinting are the most predominant phases of gait where hamstring injuries occur. During late swing, the knee is extending and the hip is flexed. The hamstring muscles are eccentrically contracting to decelerate hip and knee extension in preparation for heel strike. Lengthening the hamstring muscles during activation could induce an eccentric contraction injury. Directly following late swing, the hamstring muscles continue their activation and concentrically contract which, conversely, could induce a concentric muscle strain.

A case study presented recently by Heiderscheit et al. (2005) documented a hamstring injury while collecting kinematic data of an athlete running on a treadmill. The subject was running relatively fast at 5.36 meters/second and it was determined that his biceps femoris was strained just prior to foot contact in the late portion of the swing phase. The biceps femoris has been reported as being significantly injured more often than the other hamstring muscles at an incidence upwards to 80%. This case study supports the theory that hamstring injuries occur at this time in the gait cycle.

The second theory hypothesizes that injury is most likely to occur later in the stance phase at toe-off where the length of the hamstring muscles aren't at their longest but where the largest peak torque levels are observed. Like early stance, if injured during this phase, the injury would be concentric in nature due to the concentrically contracting hamstrings which are assisting in hip extension. Despite the evidence provided by Heiderscheit et al. (2005), the dismissal of this second theory would be premature. The first theory discussed may describe the majority of hamstring strains but current evidence cannot disprove the possibility of this second theory. Due to this reasonable second theory and a lack of evidence to disprove, this aspect of the running gait should still be considered an important aspect of preventing and rehabilitating hamstring injuries and properly training an individual. Late swing phase as well as late stance phase occur at significantly different phases in the gait cycle. Being unable to rule out either possible phase for hamstring injuries, it is mandatory to at least study these two distinct aspects of the gait cycle. With the gait cycle being cyclic in nature, all aspects of the gait cycle should still be investigated.

One single causative factor has not been identified as predominant when evaluating the injury mechanism of strained hamstrings. The current literature suggests that there are several contributing factors which can cause hamstring injuries. The primary factors are further discussed. Each factors contribution to a possible machine application is further commented on.

Low hamstring strength is theorized as being a cause of hamstring injury. A high ratio of quadriceps strength to hamstring strength has further been suggested to increase the probability of a hamstring injury. This, however should not necessarily suggest that a weakness in hamstring strength is needed to cause injury, but rather just a disproportional quadriceps to hamstring strength ratio. It has been suggested that eccentric muscle strength may be a more significant factor than concentric muscle strength as a determinant of injury due to the functional eccentric role of the hamstrings during running gait. Results from just testing eccentrically do not, however, confirm this theory. The same can be said about measuring muscle strength concentrically. With all these conflicting results it is very difficult to draw any strong conclusions on the proper way to strengthen the leg musdes.

When considering quadriceps and hamstring strengths as causes for hamstring injuries, it might be less appropriate and very limited to solely use concentric and eccentric strength evidence as predictors of hamstring injuries but more appropriate to look at previous strengthening program results when determining what factor muscle strength has on hamstring injuries. It is has been found that increasing eccentric strength can improve the ability of a muscle to withstand forces and subsequently not fail. Current training regimens may involve increasing lower limb strength in general and might induce excessive quadriceps strength which might lead to injury.

A program involving the antagonistic dynamic training of the quadriceps and hamstring muscles, simultaneously over the entire range of applicable forces and speeds these muscles might encounter might serve as the best method for training the hamstrings correctly to reduce injury rates. However, there is currently not a machine available on the market that is capable of fulfilling this recommendation.

Many neuromuscular events take place during the running gait in order to control hip and knee motion in late swing and provide hip extensor torque in early stance. Since running is a relatively fast motion, these events occur over a very short period. If control and coordination are inadequate, muscle strain injury might result. It has been suggested that a method for adequately training the hamstrings must include improving neuromuscular control of the leg during swing phase. If an error is made in the control of the swinging leg at times when high hamstring forces exist, a strain is possible.

During the swing phase, when hamstring muscles are eccentrically contracting and decelerating the lower leg, high forces are generated and if fatigue occurs an injury may result. Improper synchronization of the dual innervation pattern seen between the short head of the biceps femoris and the remainder of the hamstring muscles might introduce an injury mechanism. A mistiming on contraction of the biceps femoris due to fatigue might reduce the ability of the hamstring muscles to generate sufficient forces and lead to a hamstring injury Improving neuromuscular control of the leg during the swing phase is recommended for reducing the likelihood of incurring a hamstring injury. Actively assisting limbs along a predetermined trajectory has been found to increase neuromuscular control of the assisted limb when the limb is no longer in a controlled environment.

Individuals who exhibit poor neuromuscular control during injury prone movements have been trained to correct these neuromuscular deficiencies and consequently reduced their chance of injury. This has been documented thoroughly in the ACL (Anterior Cruciate Ligament) mechanism of injury for female athletes. Functional training was introduced to correct these neuromuscular deficits and injury rates diminished. These findings have not yet been applied to the hamstring muscle mechanisms of injury. This might be in part due to the lack of a proper machine to facilitate this functional training. Taking the above information into consideration, actively assisting the foot while mimicing the swing phase of running might help improve the neuromuscular control of the lower limb and further reduce the risk of injury to the lower extremity.

Muscle flexibility is said to reflect the muscle's ability to lengthen and absorb forces. It hasn't been established whether decreased muscle flexibility is a potential risk factor for injury or a consequence of other factors which lead to injuries. Conditioning the hamstring muscles by placing the leg in positions seen during running should able the leg to at a minimum absorb forces seen during those same positions when actually running. This would inherently decrease the risk of incurring a hamstring injury.

Properly training an individual to achieve their peak sprinting performance, while also reducing their risk of injury, demands a multifaceted approach involving all aspects of muscular training. Functionally exercising the lower limb as if it were sprinting might help improve lower limb strength in proper proportions. This might also help neuromuscular control of the limb while sprinting which may decrease injury rates and enhance sports specific performances. More research has been called upon to further develop knowledge on each of these respective factors and their relative contribution to hamstring strains. Recommendations have been made to incorporate all of these factors into preventative and rehabilitative strengthening programs. If exercise programs are implemented that positively affect these factors, the probability of an injury occurring or reoccurring might decrease.

With the foregoing in mind, a need for a training method and exercise apparatus to improve running performance while reducing the hamstring running injury mechanism has been established.

SUMMARY OF THE INVENTION

It is, therefore, an object of the present invention to provide an exercise apparatus including a support frame upon which is mounted a track, the track substantially conforming to a runner's footpath while striding. A first foot engaging support is secured to the track for movement thereabout while exercising. A resistance assembly is secured to the foot engaging support for applying resistance as a user moves the foot engaging support about the track.

It is also an object of the present invention to provide an exercise apparatus wherein the track is vertically oriented.

It is also another object of the present invention to provide an exercise apparatus wherein the shape of the track is approximately formed in accordance with the formulas $x=L*\cos(c)-M*\cos(a-b)$ and $y=L*\sin(c)-M*\sin(a-b)$, where c is thigh angle relative to a horizontal at a hip joint, a is knee angle, b is $2\pi-c$, L is femur length, and M is tibia length plus shoe sole thickness.

It is also a further object of the present invention to provide an exercise apparatus including a first static foot platform positioned adjacent a first side of the track.

It is another object of the present invention to provide an exercise apparatus including a second foot engaging support.

It is still another object of the present invention to provide an exercise apparatus wherein the first foot engaging support on a first side of the track and the second foot engaging support on a second side of the track.

It is yet another object of the present invention to provide an exercise apparatus including a first static foot platform positioned adjacent the first side of the track and a second foot platform positioned adjacent the second side of the track.

It is also a further object of the present invention to provide an exercise apparatus wherein the resistance assembly is a weight stack secured to the first foot engaging support.

It is still a further object of the present invention to provide an exercise apparatus wherein the resistance assembly further includes an electromagnetic resistance assembly secured to the first foot engaging support.

It is yet a further object of the present invention to provide an exercise apparatus wherein the resistance assembly is an electromagnetic resistance assembly secured to the first foot engaging support via a belt.

It is also another object of the present invention to provide an exercise apparatus wherein the resistance varies as the first foot engaging support moves about the track.

It is also an object of the present invention to provide an exercise apparatus including a support frame upon which is mounted a curvilinear track. A slide including a curvilinear carriage rides upon the curvilinear track and a first user engaging support is coupled to the slide for movement about the curvilinear track. A linear carriage rides upon a linear carriage rail supported by the support frame and a resistance assembly is coupled to the linear carriage. A slide bar links the curvilinear carriage of the slide to the linear carriage for the application of resistance as the user engaging support is moved about the curvilinear track.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

It is the intent of the present invention to enhance an athlete's performance in a specific activity and reduce injury occurrence during that activity by training the athlete in a manner that mimics the activity as closely as possible. More specifically, where the activity is running, it is beneficial to create a training environment that simulates the lower limb motions involved during running, thus enhancing running performance and reducing the chance of a hamstring strain.

The present invention is designed to accurately capture the running system, and the fundamental components of the present invention, therefore, revolve about an in depth knowledge of the trajectory of the athlete's leg as it moves while running. All forces used to propel the body forward during running attenuate from the reaction force exerted from the ground, to the foot and then throughout the leg and the rest of the body. All propulsive forces in running act in the opposite direction of the trajectory of the point in contact with the force. In running, the point of contact is the foot. Therefore, during specificity training, forces need to be applied along the trajectory of the foot to properly train the leg. In order to properly accomplish this goal, the trajectory of the foot during running must be documented and well understood. In the development of the present invention, the characteristics of an athlete's stride were carefully studied and applied to create the present exercise apparatus especially suited for exercising an athlete's hamstring.

Figure 1:
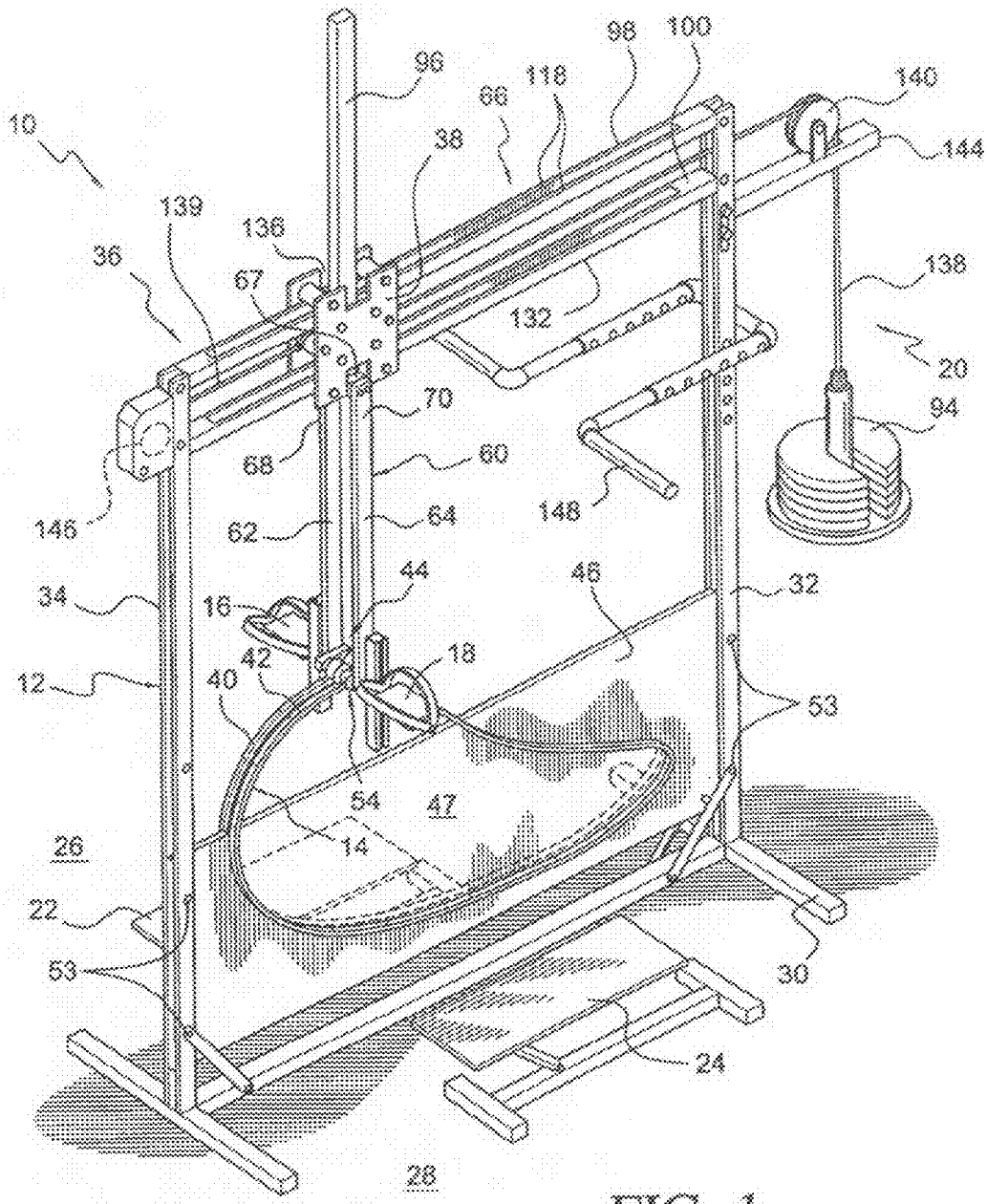
FIG. 1 is a perspective view of an exercise apparatus in accordance with an embodiment of the present invention.
Figure 2:
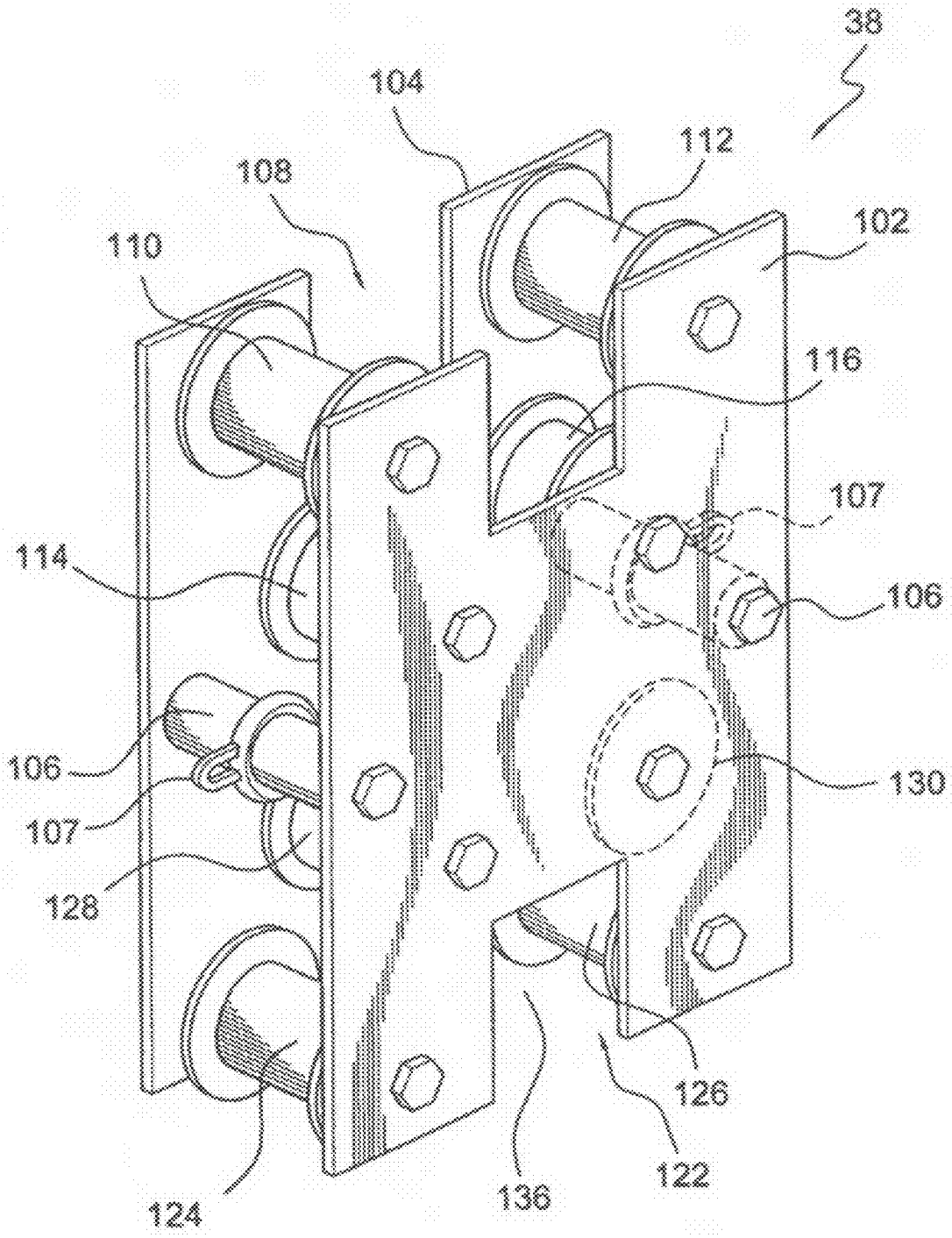
FIG. 2 is a perspective view of a linear carriage utilized in conjunction with the embodiment shown in FIG. 1.
Figure 3:
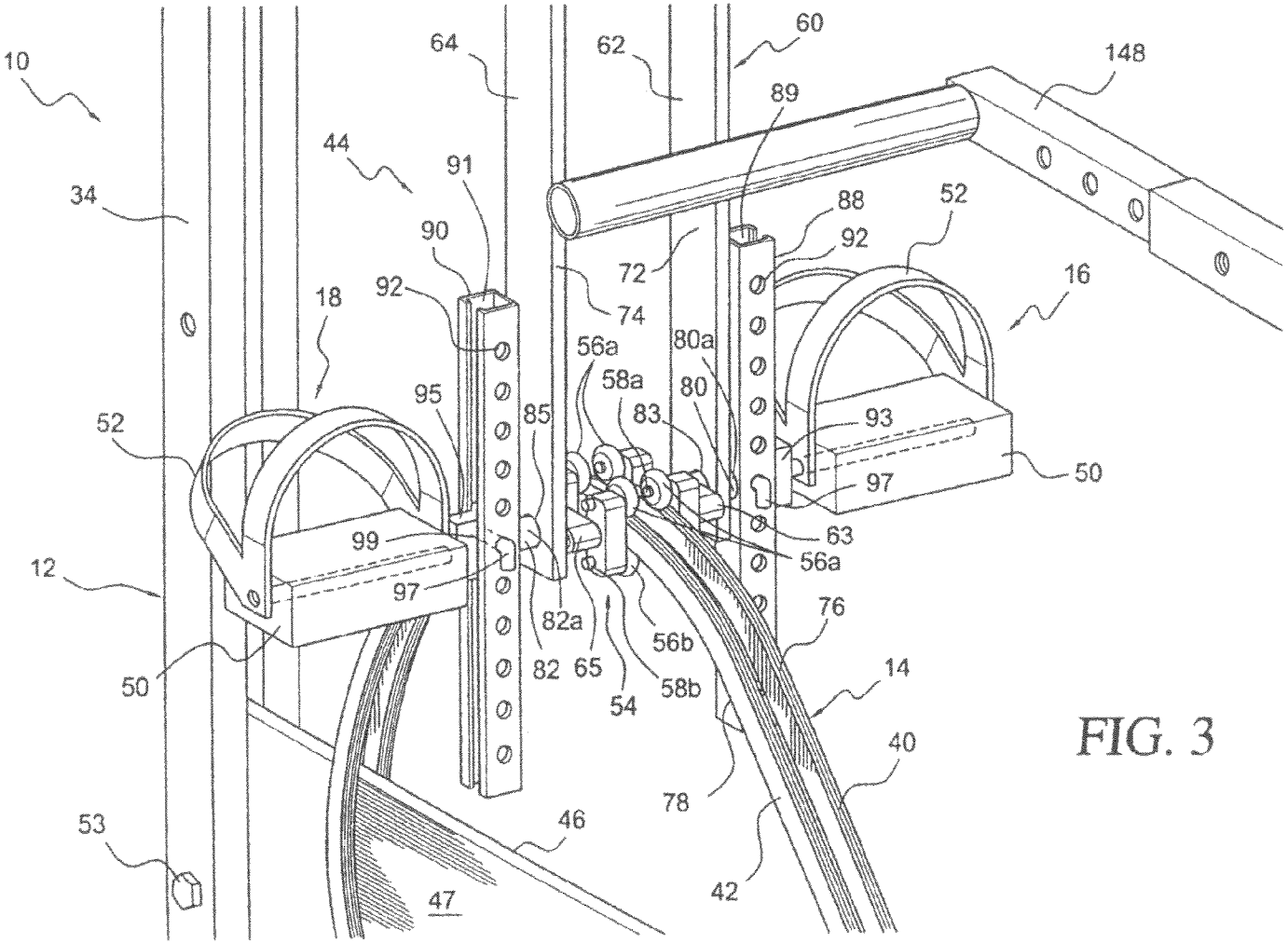
FIG. 3 is a detailed perspective view of the embodiment shown with reference to FIG. 1.

Referring to FIGS. 1 to 3, an exercise apparatus 10 in accordance with a preferred embodiment of the present invention is disclosed. Briefly, the exercise apparatus 10 includes a support frame 12 upon which is mounted a vertically oriented, curvilinear track 14. The curvilinear track 14 substantially conforms to the path of a runner's foot while striding with an arcuate path discussed and described below in greater detail. The exercise apparatus 10 includes first and second foot engaging supports 16, 18 mounted upon opposite sides of the curvilinear track 14 for movement thereabout while exercising in accordance with the present invention. A resistance assembly 20 is secured to the first and second foot engaging supports 16, 18 for applying resistance as a user moves the foot engaging supports 16, 18 about the curvilinear track 14. In fact, the resistance assembly 20 varies the resistance applied to the first and second foot engaging supports 16, 18 as they are moved about the curvilinear track 14 to optimize exercise applied to the leg being exercised.

The exercise apparatus 10 also includes a slide 44 having a curvilinear carriage 54 that rides upon the curvilinear track 14, wherein the first and second user engaging supports, that is, the first and second foot engaging supports 16, 18 are coupled to the slide 44 for movement about the curvilinear track 14. A linear carriage 38 rides upon a linear carriage rail 36 supported by the support frame 12 and the resistance assembly 20 is coupled to the linear carriage 38. A slide bar 96 links the curvilinear carriage 54 of the slide 44 to the linear carriage 38 for the application of resistance as the first and second foot engaging supports 16, 18 are move about the curvilinear track 14 by an individual using the exercise apparatus 10.

As will be appreciated based upon the following disclosure, the exercise apparatus 10 includes first and second static foot platforms 22, 24 positioned adjacent to the support frame 12 on opposite sides, that is, respectively the first and the second sides 26, 28 of the curvilinear track 14. The first and second static foot platforms 22, 24 provide a user support for one foot, and leg, while the other foot and leg are moved about the curvilinear track 14 in accordance with the present invention.

Referring to FIGS. 1, 2 and 3, the support frame 12 of the present exercise apparatus 10 includes a base structure 30 having first (forward) and second (rearward) upwardly extending support bars 32, 34 extending therefrom. The first and second upwardly extending support bars 32, 34 are substantially parallel and a linear carriage rail (or linear carriage track) 36 for applying linear resistance to the first and second foot engaging supports 16, 18 extends between the first and second upwardly extending support bars 32, 34 for supporting a linear carriage 38 for reciprocating motion as discussed below in greater detail.

The curvilinear track 14 is mounted within the central space defined by the base structure 30, the first and second upwardly extending support bars 32, 34 and the linear carriage rail 36. The curvilinear track 14 includes first and second horizontally oriented engagement surfaces 40, 42 upon which a slide 44, discussed below in greater detail, rides permitting exercise in accordance with the present invention. In order to create a stable track structure, the curvilinear track 14 is secured to a track support plate 46, and the first and second horizontally oriented engagement surfaces 40, 42 extend outwardly from opposite sides of the track support plate 46, such that a portion of the internal space 47 defined by the curvilinear track 14 is filled in with the track support plate 46.

Figure 10:
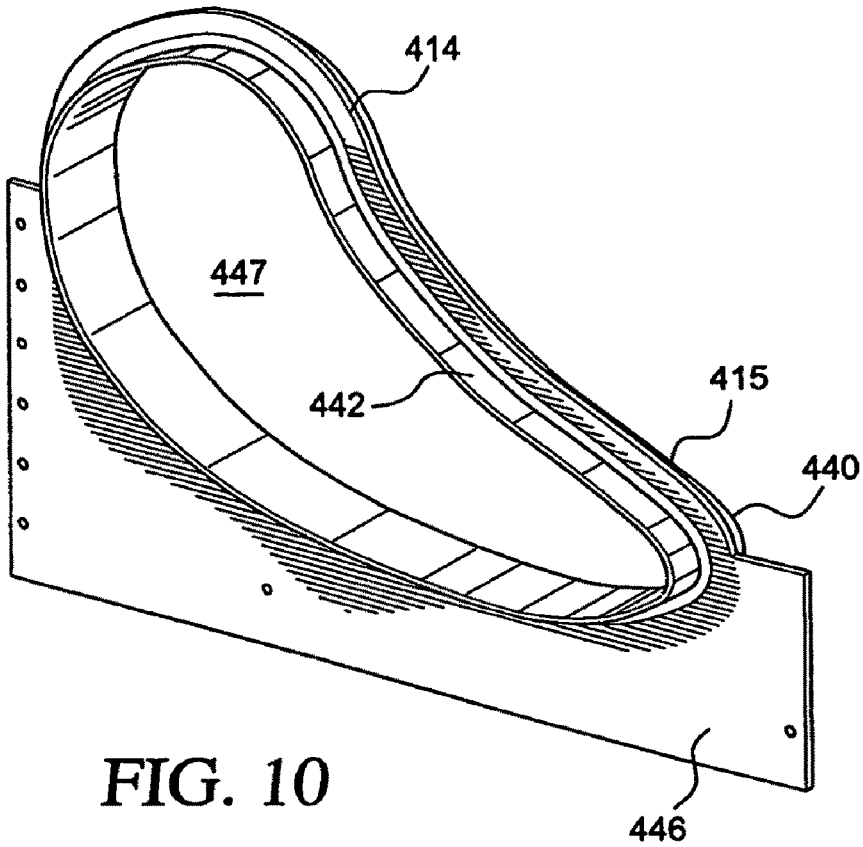
FIG. 10 shows an alternate track construction in accordance with the present invention.

Although the curvilinear track 14 is disclosed above with reference to FIGS. 1 to 3 as being composed of first and second horizontally oriented engagement surfaces 40, 42 which extend outwardly from the track support plate 46 and are held in a spaced relationship by the support plate, the curvilinear track 414 may be integrally formed (and still supported by the support plate 446) as shown in FIG. 10 with an open internal space 447 and a ridge 415 separating the first and second horizontally oriented engagement surfaces 440, 442.

Connecting bolts 53 secure the curvilinear track 14 and track support plate 46 to the support frame 12. The slide 44 secures the first and second foot engaging supports 16, 18 to the curvilinear track 14 for movement thereabout. As the slide 44 rides directly upon the curvilinear track 14, the first and second foot engaging supports 16, 18 are supported to ride along the path of the curvilinear track 14.

In accordance with a preferred embodiment, the slide 44 includes a curvilinear carriage 54 to which opposed first and second inwardly directed wheels 56*a*, 56*b* and bearings 58*a*, 58*b* are secured. The curvilinear carriage 54 includes a U-shaped support member (or U-bar) 60 including a first leg 62, a second leg 64 and a connecting member 67 secured between the upper ends 68, 70 of the first and second legs 62, 64. As such, the lower ends 72, 74 of the first and second legs 62, 64 are free to engage the curvilinear track 14 (via wheel assemblies 63, 65 discussed below) and fit about the track support plate 46 as the first and second foot engaging supports 16, 18 are moved about the curvilinear track 14 during exercise.

More particularly, first and second inwardly directed wheel assemblies 63, 65 are secured to each of the first and second legs 62, 64 adjacent the lower ends 72, 74 thereof. The first and second wheel assemblies 63, 65 support the respective first and second inwardly directed wheels 56*a*, 56*b* such that they are respectively supported upon the outer and inner surfaces 76, 78 of the curvilinear track 14, more particularly, the first and second horizontally oriented engagement surfaces 40, 42, in a manner securely coupling the slide 44 to the curvilinear track 14 allowing the slide 44 to move about the curvilinear track 14 in a desired manner. First and second pin connection rods 80, 82 extend through apertures 83, 85 into the first and second legs 62, 64 to pivotally secure the first and second legs 62, 64 to the first and second wheel assemblies 63, 65 such that the first and second wheel assemblies 63, 65 may rotate relative to the U-shaped support member 60 as the curvilinear carriage 54 is moved about the curvilinear track 14 (see FIGS. 23 to 28). That is, the first and second wheel assemblies 63, 65 are free to pivot and follow the contour of the curvilinear track 14 while the U-shaped support member 60 remains substantially vertically oriented.

The first and second pin connection rods 80, 82 respectively extend outwardly from the first and second legs 62, 64 adjacent the lower ends 72, 74 thereof. The outer ends 80*a*, 82*a* of the respective first and second pin connection rods 80, 82 are each provided with an elongated adjustment bar 88, 90. Each of the adjustment bars 88, 90 is substantially U-shaped defining a slot 89, 91 in which a support block 93, 95, to which the first and second foot engaging supports 16, 18 are pivotally secured, is mounted for selective movement along the length of the adjustment bar 88, 90 in a manner permitting ready adjust of foot position. Each of the adjustment bars 88, 90 includes a plurality of spaced apertures 92 shaped and dimensioned for selectively receiving a locking pin 97 that engages both the spaced apertures 92 of the adjustment bar 88, 90 and an aperture 99 within the support block 93, 95 for locking the support block 93, 95, and ultimately the first and second foot engaging support 16, 18, in position along the adjustment bar 88, 90. As those skilled in the art will certainly appreciate, the first and second inwardly directed wheels 56*a*, 56*b* and bearings 58*a*, 58*b* should be chosen to accommodate the lifespan of the exercise apparatus 10 and be fitted into place.

As discussed above, the motion of leg is curvilinear as it is moved about the curvilinear track 14 in accordance with the present exercise apparatus 10 and resistance is applied to the slide 44, and ultimately the first and second foot engaging supports 16, 18, via the resistance assembly 20. In accordance with a preferred embodiment, the resistance assembly 20 translates the curvilinear motion of the slide 44 moving about the curvilinear track 14 to linear motion of a weight stack 94 moving up and down. This is achieved such that the force applied to the user's leg is varied as the user moves his or her leg about the curvilinear track 14.

More particularly, and in accordance with a preferred embodiment, the curvilinear motion of the leg as it moves about the curvilinear track 14 is transferred to a linear, horizontal motion where resistance may appropriately be applied via a resistance mechanism, for example, the weight stack 94 shown with reference to the embodiment of FIGS. 1 to 3. As will be appreciated based upon the following disclosure, although a weight stack is disclosed for use in accordance with the embodiment shown in FIGS. 1 to 3, other resistance structures, for example, an electromagnetic resistance assembly as disclosed with reference to FIGS. 4 and 5, may be employed without departing from the spirit of the present invention.

A weight stack 94 has many benefits. Many athletes like the idea of a weight being visible so you can see it being lifted. Athletes are accustomed to weights and would view the machine as more of a "free weight" machine and less of a gimmick such as those machines that offer resistance in the form of a bow or spring that are supposed to strengthen the leg. Also, with the weight stack, you get a condition known as "dead weight" when changing directions at the phase boundaries. This is usually a frowned upon condition in the gym, but might be beneficial in this case. "Dead weight" is a lag in movement that is created due to the inertia created by the mass of the weight. This causes the body part being worked to want to continue in its original path and create a resistance to a new path. In many exercises this is not ideal, but one of the functions of the hamstring is to slow down the leg before it touches the ground and then instantaneously contract to pull the leg in the opposite direction. The dead weight mimics and amplifies this natural occurrence and thus should help develop the hamstring to a greater extent. A weight stack is also easily adjustable and virtually maintenance free which is a large factor in choosing this means of resistance.

In accordance with a preferred embodiment, and as particularly shown with reference to FIGS. 1 to 3, force is translated to the slide 44 via the resistance assembly 20 which generally includes a weight stack 94 linked to a linear carriage (or linear slide) 38 that is ultimately linked to a slide bar 96 fixedly and rigidly coupled to the slide 44 and the first and second foot engaging supports 16, 18. As will be discussed below in greater detail, the linear carriage 38 is supported upon the support frame 12 for linear movement in a horizontal plane. More particularly, and as briefly discussed above, the support frame 12 includes a linear carriage rail 36 which is shaped and dimensioned to support the linear carriage 38 for reciprocating motion as described herein. In accordance with a preferred embodiment, the linear carriage rail 36 includes an upper, or first, guide rail member 98 and a lower, or second, guide rail member 100. The upper and lower guide rail members 98, 100 extend between the first and second upwardly extending support bars 32, 34 and provide a railway for movement and support of the linear carriage 38.

The linear carriage 38 includes a framework with wheels and bearings that engage the support frame 12 of the exercise apparatus 10 for movement relative thereto in a horizontal plane. In particular, and with reference to FIG. 2, the linear carriage 38 includes opposed mounting plates 102, 104 held together by bolts 106 (with attached clips 107 for coupling to cables 138, 139 of the resistance assembly 20) in a spaced relationship. An upper wheel assembly 108 and a lower wheel assembly 122 are secured between the mounting plates 102, 104 and are respectively shaped and dimensioned to engage the upper and lower guide rail members 98, 100. The upper wheel assembly 108 includes first and second laterally spaced upper wheels 110, 112 and first and second laterally spaced lower wheels 114, 116 secured between the mounting plates 102, 104. The first and second laterally spaced upper wheels 110, 112 are spaced laterally outside of the first and second laterally spaced lower wheels 114, 116. The lower wheel assembly 122 includes first and second laterally spaced lower wheels 124, 126 and first and second laterally spaced upper wheels 128, 130 secured between the mounting plates 102, 104. As with the upper wheel assembly 108, the first and second laterally spaced lower wheels 124, 126 are spaced laterally outside of the first and second laterally spaced upper wheels 128, 130. The first and second laterally spaced upper wheels 110, 112 of the upper wheel assembly 108 and first and second laterally spaced lower wheels 124, 126 of the lower wheel assembly 122 respectively engage the top surface 118 of the upper guide rail member 98 the bottom surface 132 of the lower guide rail member 100 for supporting the linear carriage 38 thereon.

The linear carriage 38 further includes a vertically oriented, central aperture 136 shaped and dimensioned for engagement with the slide bar 96 extending upwardly from the slide 44. As will be appreciate based upon the following disclosure, movement of the slide bar 96 through the central aperture 136 of the linear carriage 38 is facilitated by a central opening 66 in the linear carriage rail 36 through which the slide bar 96 also passes. The central aperture 136 is defined by the first and second laterally spaced lower wheels 114, 116 of the upper wheel assembly 108 and the first and second laterally spaced upper wheels 128, 130 of the lower wheel assembly 122 to provide a passageway through which the slide bar 96 may freely move while still being laterally supported by the wheels 114, 116, 128, 130. More particularly, the slide bar 96 is connected to the connecting member 67 of the U-shaped support member 60 of the slide 44. It is shaped and dimensioned to engage the linear carriage 38 for ultimately translating the motion of the first and second foot engaging supports 16, 18 to the weight stack 94. The slide bar 96 passes through the central aperture 136 of the linear carriage 38. In this way, the slide bar 96 is free to move up and down relative to the linear carriage 38 while being pushed laterally as one moves the first and second foot engaging supports 16, 18 about the curvilinear track 14. Since the linear carriage 38 is moved laterally, this motion is translated to the weight stack 94 which connects the linear carriage 38 to the weight stack 94. More particularly, and as mentioned earlier, it has been found to be most effective to translate the curvilinear motion of the foot engaging supports 16, 18 about the curvilinear track 14 to a one-degree of freedom, horizontal, linear system as embodied by the motion of linear carriage 38.

It is contemplated one can significantly reduce the height of the fixture by creating a different foot track than shown in the various figures. For example, if the track was split in half down the plane of symmetry, the mounting of the slides could be in the center of the exercise apparatus, not the outside. This would mean that the U-shaped engaging member could be modified to that of just a shaft that runs between the two identical tracks and not have to surround the original track. This would reduce the height of the exercise apparatus by the height of the track which is approximately 80 cm. If a weight stack is used, as shown in FIG. 1, the vertical distance traveled by the weight is equal to that of the horizontal distance traveled by the foot and consequently the linear carriage 38. This consequently requires the vertical distance from the top weight in a stack to the pulley (which is aligned with the horizontal slide) must be greater than the horizontal distance traveled by the slide.

Figure 18:
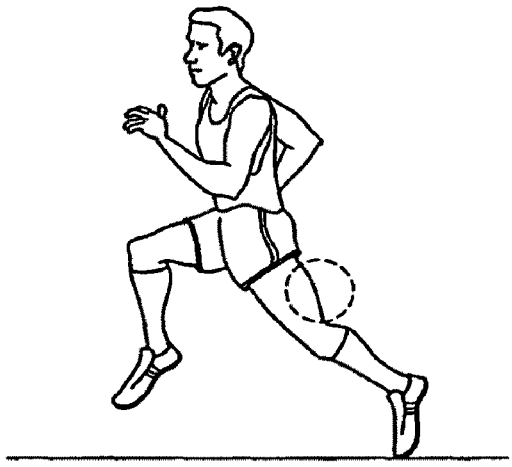
FIG. 18 shows concentric motion of the leg during running.
Figure 19:
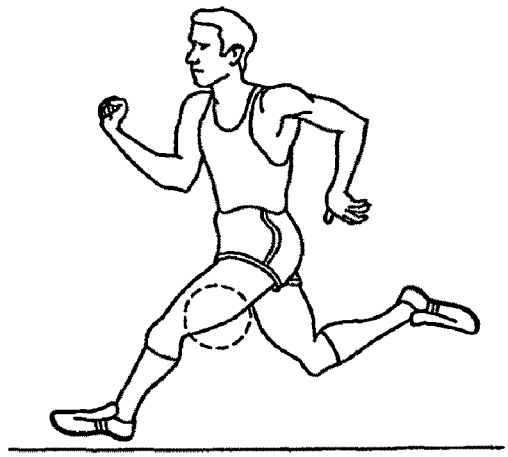
FIG. 19 shows eccentric motion of the leg during running.

As mentioned above, the linear carriage 38, and ultimately the first and second foot engaging supports 16, 18, are coupled to a resistance assembly 20, for example, a weight stack 94. In accordance with the present invention, it has been noticed that if the movement of the horizontal system (that is, generally the linear carriage 38 and the weight stack 94) is resisted, the forces should translate to the athlete's foot quite nicely via the slide 44 and the first and second foot engaging supports 16, 18. This is a closed loop path so resistance is needed in both directions and the resistance in the eccentric direction must be different than that in the concentric direction. As a result, and in accordance with a preferred embodiment of the present invention, the motion of an athlete's foot about the curvilinear track 14 has been divided into two phases. The first phase is when the foot is contracting (see FIG. 18). The second phase is when the foot is eccentrically extending (see FIG. 19). Both of these phase's boundaries are at the horizontal extremes of the leg motion.

The first phase of the present exercise apparatus 10 is the most researched part of the entire exercise apparatus 10, as it is the only phase of leg movement current weight machines attempt to work. As mentioned above, in accordance with a preferred embodiment, a cable 138 is attached from the weight stack 94 to the linear carriage 38 with a pulley 140 guiding the cable 138 therebetween.

As a result, the weight stack 94 is linked to the linear carriage 38 and ultimately the slide 44 via the cable 138 which passes over the pulley 140 and is ultimately secured to the weight stack 94. In order to ensure acceptable spacing between the weight stack 94 and the user of the present invention, the pulley 140 is secured to the free end of a support bar 144 extending from the first upwardly extending support bar 32 and the weight stack 94 extends therefrom. A simple weight stack 94 is shown in accordance with a preferred embodiment shown in FIG. 1. However, those skilled in the art will appreciate a variety of weight stack structures are known in the art and may be used without departing from the spirit of the present invention.

Figure 20:
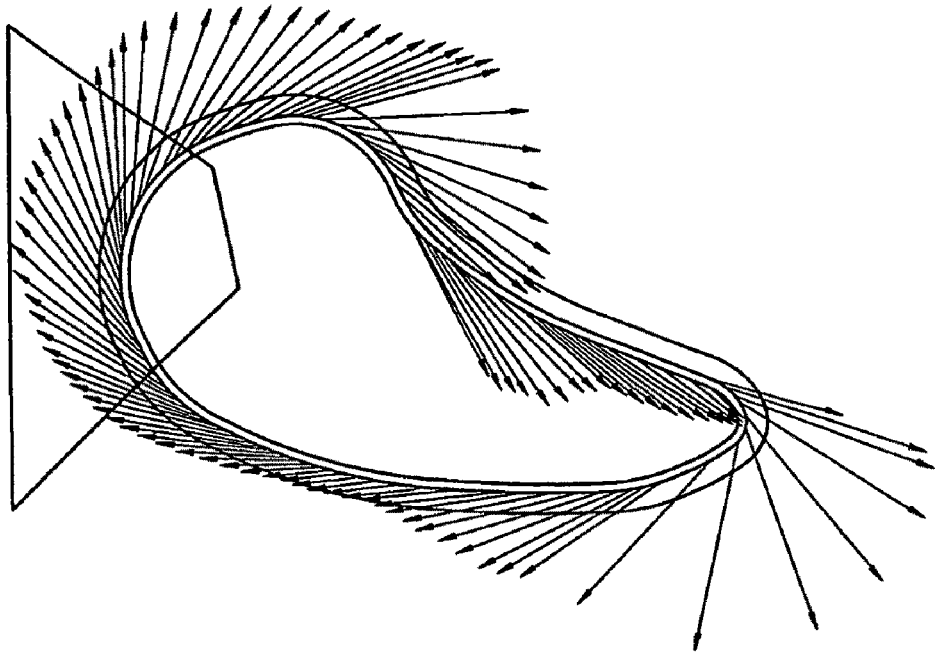
FIG. 20 shows an area of concern for the concentric motion of a leg during the first phase of leg motion.

This first phase describes the motion of the leg as the foot touches the ground and is then being pulled up and tucked toward the buttocks. The key area of concern in the first phase is in the later position of this motion highlighted in FIG. 20.

This is the portion of the movement where hamstrings are worked the greatest and the potential to strengthen them is at its greatest. By observing the tangent vectors in FIG. 20, one can see that as you encounter the later portion of this movement, the horizontal component decreases to the point to where it is almost non-existent. With the resistance being translated to the horizontal plane, the amount of force needed to move the linear carriage 38 increases and is thus felt more by the hamstring. It is believed this translation of force from the curvilinear to linear plane provides an appropriately proportionate amount of resistance that will work the hamstring effectively.

Figure 21:
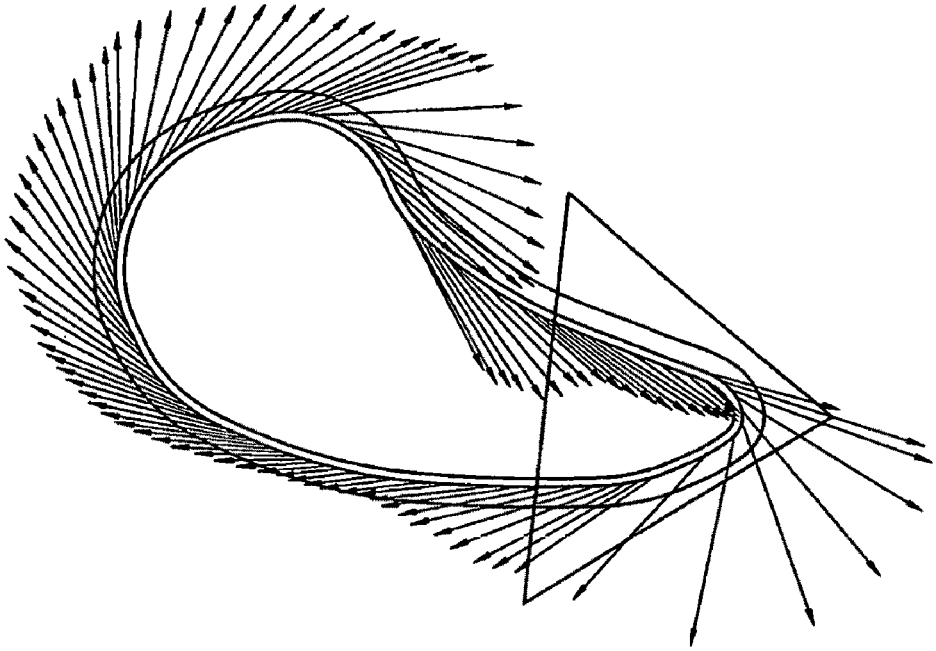
FIG. 21 shows an area of concern of eccentric motion of the leg as the leg moves from the second phase to the first phase.

The region of most concern for the second phase is the later half of the second phase where the transition between the second phase and the first phase occurs (see FIG. 21). This is where the leg is extending, the quadriceps as well as the eccentrically loaded hamstrings are firing and slowing down the inertia of the tibia. Having the weight stack 94 is a good and bad thing for this movement. At the end of the first phase and the beginning of the second phase, the weight stack 94 is going to want to pull the foot forward to where it is time to begin the first phase again. In a slow, controlled movement, this can be fine. This might be used for rehabilitation purposes. This, however, won't be good for high speed, muscle building purposes.

A separate resistance is needed to counter the weight and to supply additional resistance as needed. This resistance would of course be generated in the horizontal plane but should only work in one direction. In accordance with a preferred embodiment, a secondary resistive device, or assembly, such as an electromagnetic resistance assembly, for example, an electromagnetic brake 146, may be secured to the linear carriage 38 via a cable 139 and used for the second phase as well as the transition between the first phase and the second phase of the leg motion when used with a weight stack. In accordance with a preferred embodiment, a logic device controlled with a switch input at each phase transition can be used to trigger an appropriate current to the electromagnetic brake 146 which in turn applies a desired resistance to the forward moving linear carriage 38 and weight stack 94, although it is contemplated other control structures known to those skilled in the art may be utilized without departing from the spirit of the present invention. An electromagnetic brake 146 is easily adjustable by an operator and can offer a wide range of resistances. The exercise apparatus 10 has been designed to accommodate alterations and accommodations for alternate resistive devices or combinations therein discussed in detail below.

In accordance with an alternate embodiment of the present invention, the dual resistance assembly discussed above could be replaced with a single electromagnetic resistance assembly programmed to apply appropriate resistance along both the first phase and the second phase of the runner's stride. In particular, and with reference to FIGS. 4 to 5, an exercise apparatus 210 in accordance with an alternate embodiment is disclosed. With the exception of the components discussed below, this exercise apparatus 210 is substantially identical to that disclosed above with reference to FIGS. 1 to 3. The linear carriage 238, which rides upon a linear carriage rail 298 composed of the two rigidly constrained shafts 362, 364, is coupled to a looping belt 350 which is fixedly secured to the linear carriage 238 and passes over a forward pulley 352 and a rearward pulley 354. Either the forward pulley 352 or the rearward pulley 354, or both pulleys, is associated with an electromagnetic resistance assembly, for example, an electromagnetic brake, 356 (although the disclosed embodiment shows the rearward pulley 354) controlling resistance applied to the linear carriage 238 as one attempts to move it forward and backward. As a result, regardless of which direction the linear carriage 238 is moved, resistance to the movement thereof is applied as a result of the belt 350 attempting to turn the pulleys 352, 354 to which an electromagnetic resistance assembly 356 is coupled. Improved versatility can further be achieved by controlling the electromagnetic resistance assembly 356 with a computer 358 monitoring the position of the runner's foot along the curvilinear track 214 and accordingly adjusting the applied resistance.

With regard to the linear carriage 238 used in accordance with this embodiment, it generally includes first and second pillow blocks 360 (only the first pillow block 360 is shown and the second pillow block is identical and opposite thereto for engaging constrained shaft 364) shaped and dimensioned to glide along two rigidly constrained shafts 362, 364 extending between the fist upwardly extending support bar 232 and the second upwardly extending support bar 234.

Figure 4:
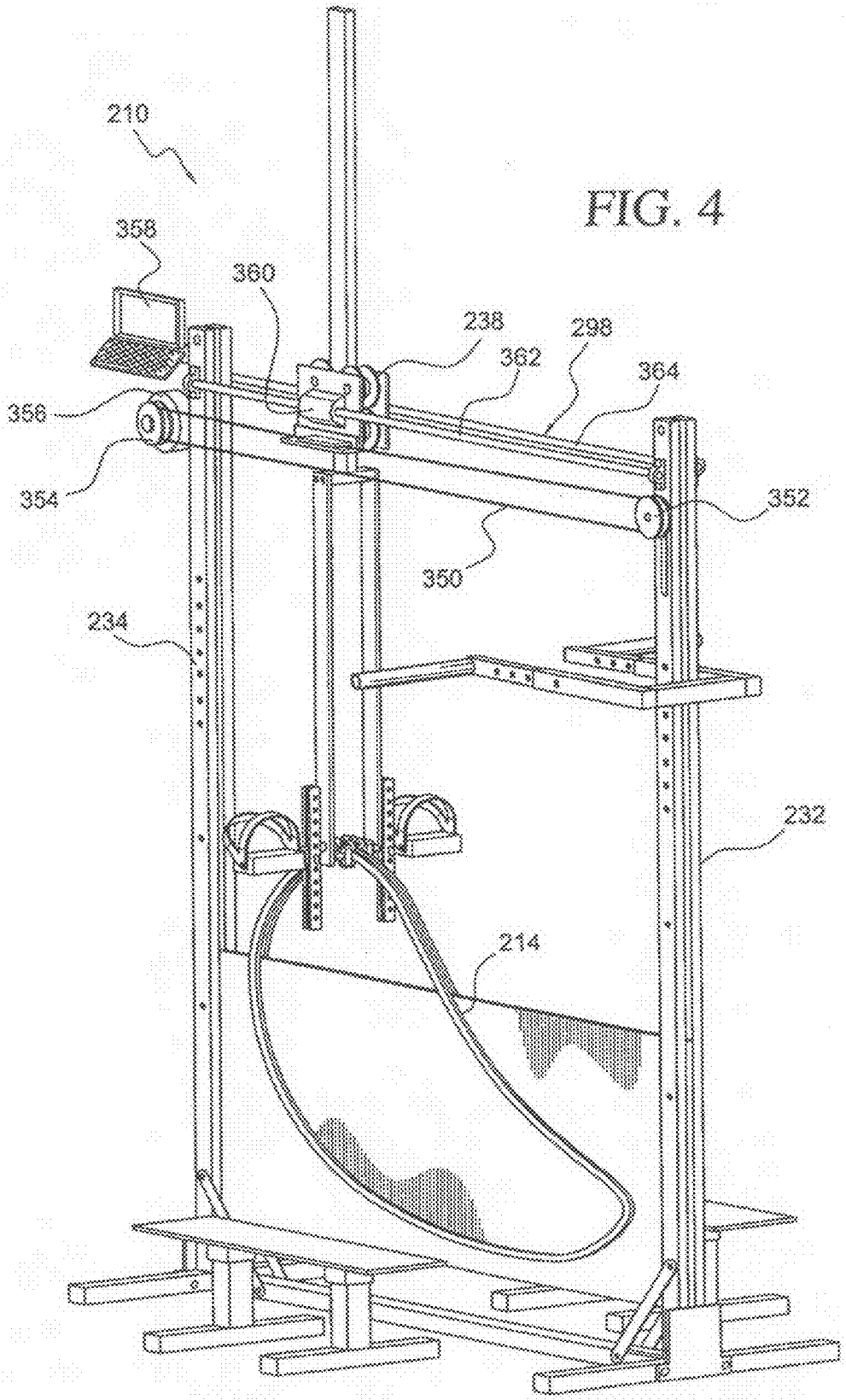
FIG. 4 is a perspective view of an exercise apparatus in accordance with an alternate embodiment.
Figure 5:
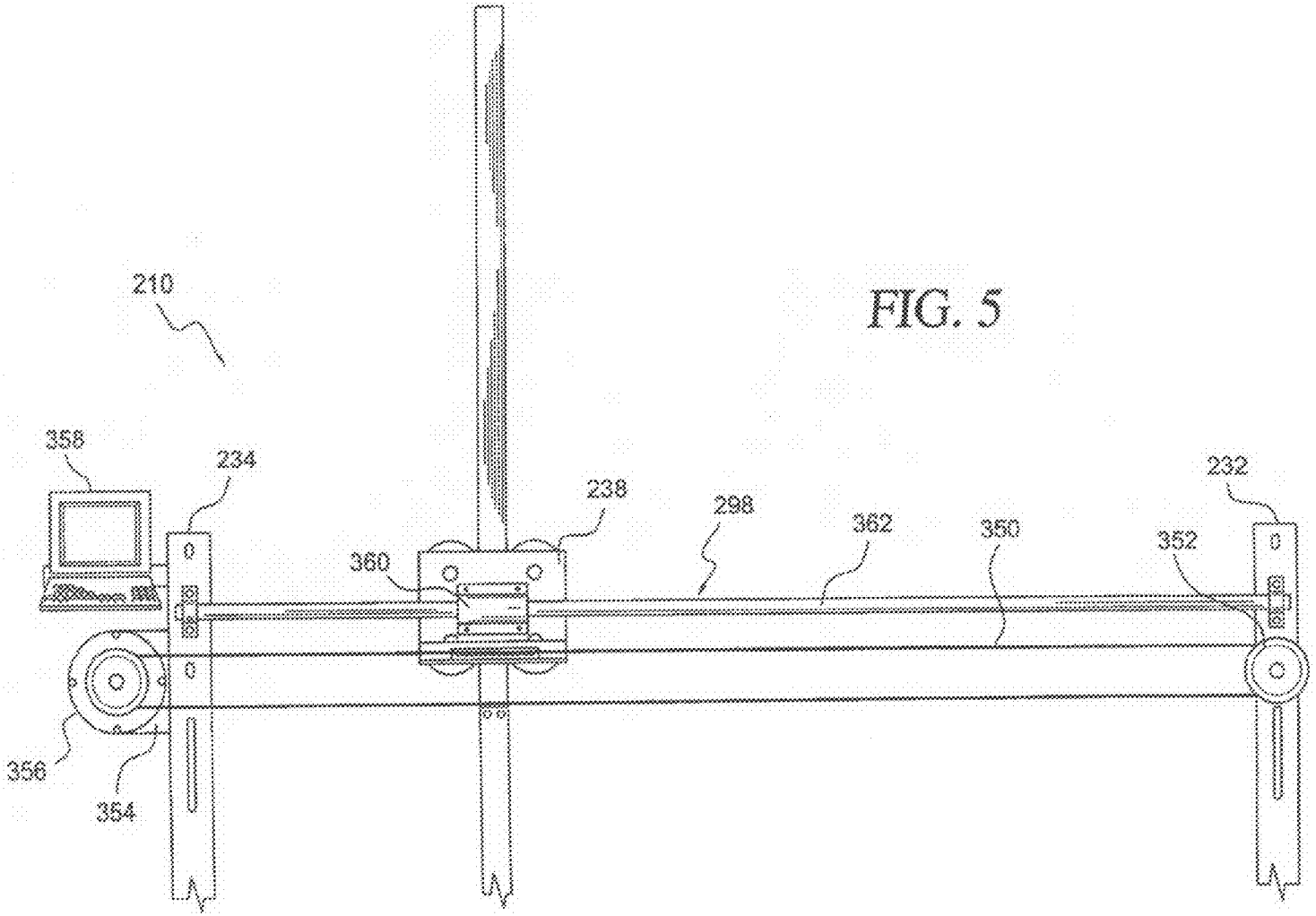
FIG. 5 is a side detailed view of the linear carriage assembly in accordance with the embodiment shown in FIG. 4.

While a wheel assembly is utilized in conjunction with the embodiment disclosed with reference to FIGS. 1 to 3 and pillow blocks are utilized in conjunction with the embodiment disclosed in FIGS. 4 and 5, those skilled in the art will appreciate that there are a variety of mechanical structures which would permit linear movement of the linear carriage along the carriage rails.

As stated above, the present exercise apparatus 10 is also provided with a stand for the leg not in use in the form of the first and second static foot platforms 22, 24. The original path of the leg is offset to the ground by approximately 25 cm. The person's stabilizing foot should be even with the lowest portion of the path. This offset "ground" will create enough room for the tallest individuals to use this device. The same holds true for shorter people. The first and second static foot platforms 22, 24 would adjust up and down accordingly and are moveable to accommodate various users.

The exercise apparatus 10 is also provided with a hand support 148 extending rearwardly from the first upwardly extending support bar 32. The hand support 148 is adjustable to accommodate users of different size and is sized to allow for gripping by both hands as the user employs the present exercise apparatus 10.

In accordance with a preferred embodiment of the present invention, the components of the present exercise apparatus are composed of aluminum, alloyed steel and other materials commonly employed in the exercise industry.

Referring to FIGS. 23 to 28, operation of the present exercise apparatus 10 shown with reference to FIGS. 1 to 3 is shown (although this description equally applies to use of the embodiment shown in FIGS. 4 and 5). The exercise apparatus 10 is shown from the point of view of working the left leg while the right leg sits on the second static foot support platform 24. Once the user is properly secured to the exercise apparatus 10 with his or her left foot secured within the second foot engaging support 18 at the highest point in the track's path and his or her right foot securely supported upon the second static foot support platform 24, the exercise process will begin (see FIG. 23). The user then moves his or her foot forward and downward with the weight stack 94 dropping and resistance supplied by the electromagnetic brake 146 of the resistance assembly 20 as discussed above for the second phase of the runner's gait (see FIG. 24). As this movement continues, the slide bar 96 moves downwardly relative to the central aperture 136 of the linear carriage 38 while the forward motion of the slide 44 and slide bar 96 causes the linear carriage 38 to move forward along the linear carriage rail 36. Movement of the slide bar 96 through the central aperture 136 of the linear carriage 38 is facilitated by the central opening 66 in the linear carriage rail 36 through which the slide bar 96 also passes. This continues until the runner's foot reaches the forward most point of the curvilinear track 14 (see FIG. 25). The runner's foot then reverses directions and begins to move rearward into the first phase of resistance as discussed above with resistance being applied as a result of the weight stack 94 being moved upwardly while the linear carriage 38 is moved rearwardly (see FIG. 26). As this movement continues, the slide bar 96 initially moves downwardly relative to the central aperture 136 of the linear carriage 38 while the rearward motion of the slide 44 and slide bar 96 causes the linear carriage 38 to move rearward along the linear carriage rail 36. Thereafter, the slide bar 96 moves upwardly relative to the central aperture 136 of the linear carriage 38 while the rearward motion of the slide 44 and slide bar 96 continues causing the linear carriage 38 to move rearward along the linear carriage rail 36 (see FIGS. 27 and 28). This continues until the runner's stride moves the second foot engaging support 18 toward the highest point, at which time resistance switches to the second phase as discussed above.

As with the prior embodiment shown with reference to FIGS. 1 to 3, the exercise apparatus shown with reference to FIGS. 4 and 5 is to be used one leg at a time. With the runner facing forward toward the first upwardly extending post, the user's leg would generate a propulsive force which enables the slide to move along the track in a clockwise fashion. The linear carriage will then move in a forward direction pulling the belt in the same direction and ultimately rotating the first and second pulleys. This is during the second phase of a runner's gait. As the runner reaches the transition between the second phase and the first phase of the runner's gait, the linear carriage will begin moving rearwardly and the cable and pulleys will also switch directions. Whether the carriage is moved forward or rearward, the electromagnetic resistance assembly applies resistance to the movement of the foot which is appropriate for that position during the stride.

Ultimately, the linear carriage is driven by an outside thrust which has been translated from the foot to the linear carriage causing linear movement. This linear movement is constantly resisted by the electromagnetic resistance assembly that is capable of administering torques in rotations for both directions.

Figure 6:
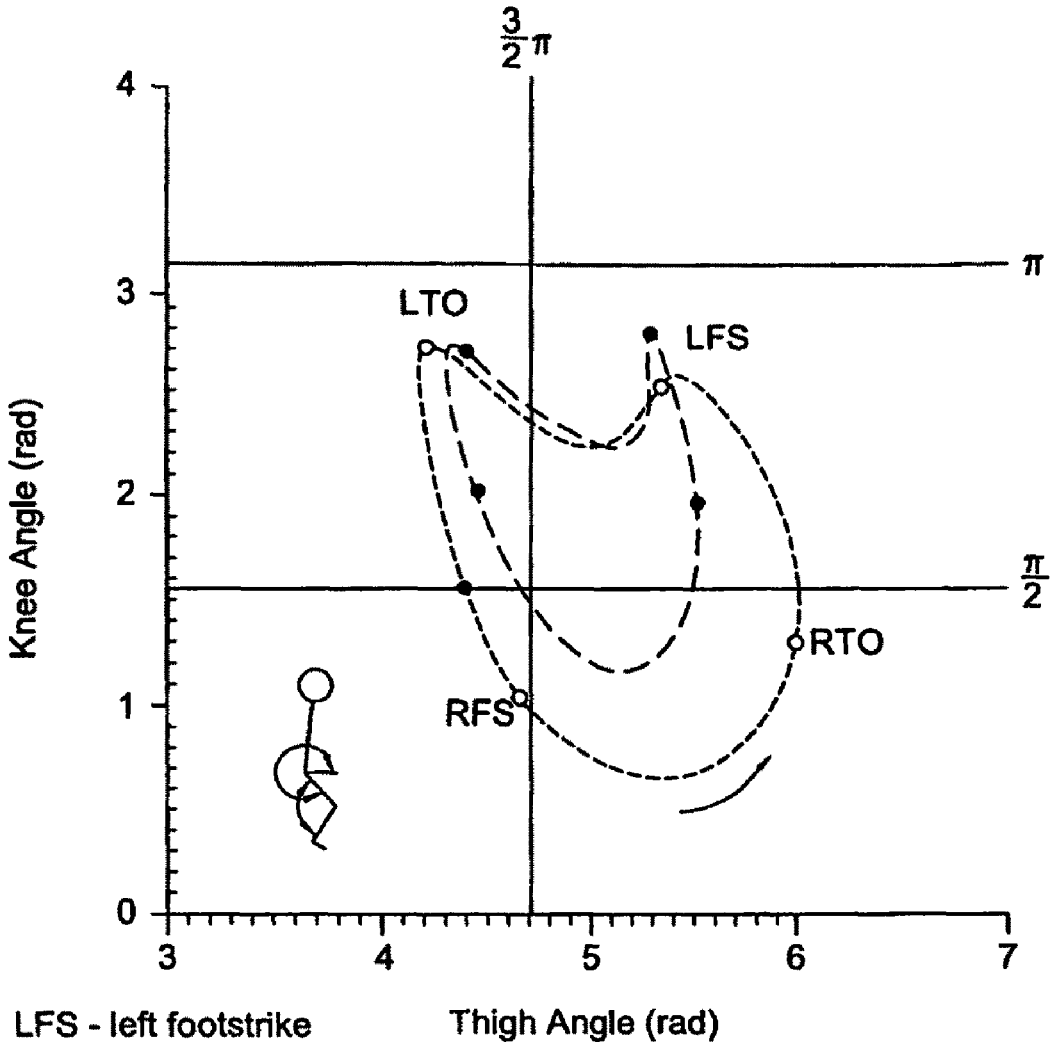
FIG. 6 is a plot showing knee angle and thigh angle during two running gaits.

While developing the present exercise apparatus many issues were considered. In particular, the curvilinear track 14 of the present exercise apparatus 10 is optimized to replicate that of a runner's gait, or stride, as he or she exercises without resistance. In developing the present exercise apparatus 10, measurements were taken from the literature regarding the thigh angle and knee angle the leg makes throughout the entire sprinting gait as shown in FIG. 6. These data indicated by the dotted line are from a male subject running at 7.6 meters/second. This is not a maximum speed for top sprinters, but is considered relatively fast. Also shown in FIG. 6 is the gait for a distance run (3.9 meters/second). It is obvious the changes in the leg position are profound and fundamentally differ from that of the sprinting gait. While these differ significantly, gaits at higher speeds will not significantly vary from that shown with regard to the gait of a runner moving at 7.6 meters/second due to limitations in human performance abilities. As such, and in accordance with a preferred embodiment of the present invention, the stride path for an individual at 7.6 meters/second gait has been chosen as the basis for the track shape, although those skilled in the art will appreciate the curvilinear track 14 shape may be varied without departing from the underlying concepts of the present invention.

These data describing the motion of the leg are in units of radians. This helps describe femur and tibia positions relative to each other, but does little to describe the position of the foot where the present exercise apparatus 10 will attach. In order to describe the position of the foot, information is needed on the length of body segments involved in conjunction with data above to form an equation to describe the position of the foot during the gait and ultimately define a path for the curvilinear track 14 employed in accordance with the present invention.

Anthropometric data concerning the average lengths of body segments was obtained from data published within a book entitled *Biomechanics and Motor Control of Human Movement* by David A. Winter, a cornerstone in the field of biomechanics. With this information, height was the only other variable needed to describe this motion. The average height for males at the $50^{th}$ percentile range is 69 inches. Information regarding the height of the $95^{th}$ percentile of the populous was available and thought was given in using this information as a height boundary for the present exercise apparatus 10 but it is prevalently known that superior athletes are usually taller than the average male as many sports benefit from individuals with height advantages. As the present exercise apparatus 10 will likely be initially used on above average athletes and the upper limit of an estimated 77 inches were disregarded and the present exercise apparatus 10 has been designed in accordance with a preferred embodiment so that it was capable of including a rare 84 inch person who would regularly use this device in a collegiate or professional training regiment. However, the average male height of 69 inches was maintained as the default setting in order to account for female athletes that on average are shorter than their male counterparts. Ultimately, those skilled in the art will appreciate the size of the present exercise apparatus may be readily varied within the spirit of the present invention to accommodate the widest range of users.

Figure 7:
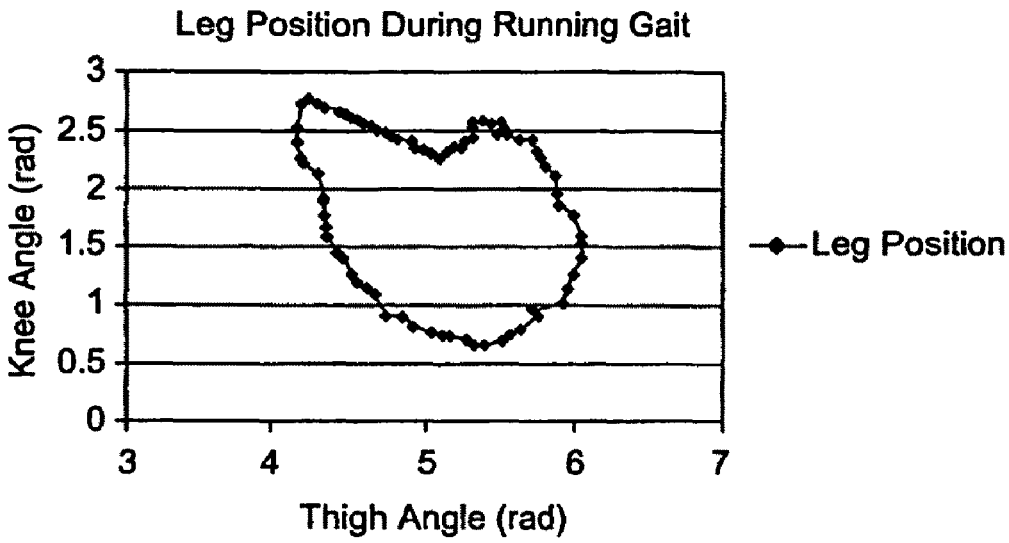
FIG. 7 is interpreted data generated from these data shown in FIG. 6.

Having acquired the body segment length information, the first step in developing an equation was to put the angle data in a workable form. All the coordinates from FIG. 6 were replicated into a spreadsheet and the plot of this is shown in FIG. 7. Human error was naturally involved due to the use of second hand peer reviewed data. Collected coordinates from FIG. 7 were smoothed with a cubic spline until these data in FIG. 6 closely resembled the collected data shown in FIG. 8. These data collected were plotted on the same scale and visually inspected until a substantial amount of error was reduced between these data sets.

Another concern with the formation of the equation is the environment in which the present exercise apparatus 10 is intended to be used. This exercise apparatus 10 is to be used by athletes under conditions similar to those encountered while working out in a gym environment. As will be discussed below in greater detail, the exercise apparatus 10 will be mounted to the foot via a pedal 50 and foot strap 52 forming part of each of the first and second foot engaging supports 16, 18 as shown best in FIG. 3. As those skilled in the art will, however, appreciate, a variety of foot securing structures known to those skilled in the art may be utilized without departing from the spirit of the present invention.

The information relating to body length segments only relates to the body segments themselves and, therefore, ends with the heel of a runner. The present exercise apparatus 10 is designed to trace the path of the leg at the point of contact with the first and second horizontally oriented engagement surfaces 40, 42. In a gym setting you need to wear athletic shoes. The pedal 50 should naturally mount to the bottom of the athletic shoe thus offsetting the actual distance from the heel to the pedal 50; a distance equal to that of the thickness of the sole of the shoe. There are hundreds, if not thousands of different types, of athletic shoes that people wear to the gym so an exact average of sole thickness is hard to determine. An assumption was needed to be made on the thickness of the shoe and, in accordance with a preferred embodiment, a sole thickness of 1½ inches was employed in developing the preferred embodiment of the preset invention.

Taking all the above into consideration, the equations to approximately describe the motion of the leg, more particularly, the position of the foot mounts, that is, the first and second foot engaging supports 16, 18, were derived. These equations have ultimately been proven to be substantially accurate by comparing the produced curves with actual data from runners. This derivation is shown below (with English units converted to metric units; and "*" indicates multiplication).

The average height of athletes in meters, H, is given as $$H=I*0.0254 \quad 3.1$$

Where I is the average height of athletes in inches.

The length of the Femur, L, is given as $$L=0.245*H \quad 3.2$$

The length of the tibia plus the shoe sole thickness is represented as M and is given as $$M=0.285*H+0.037 \quad 3.3$$

Figure 8:
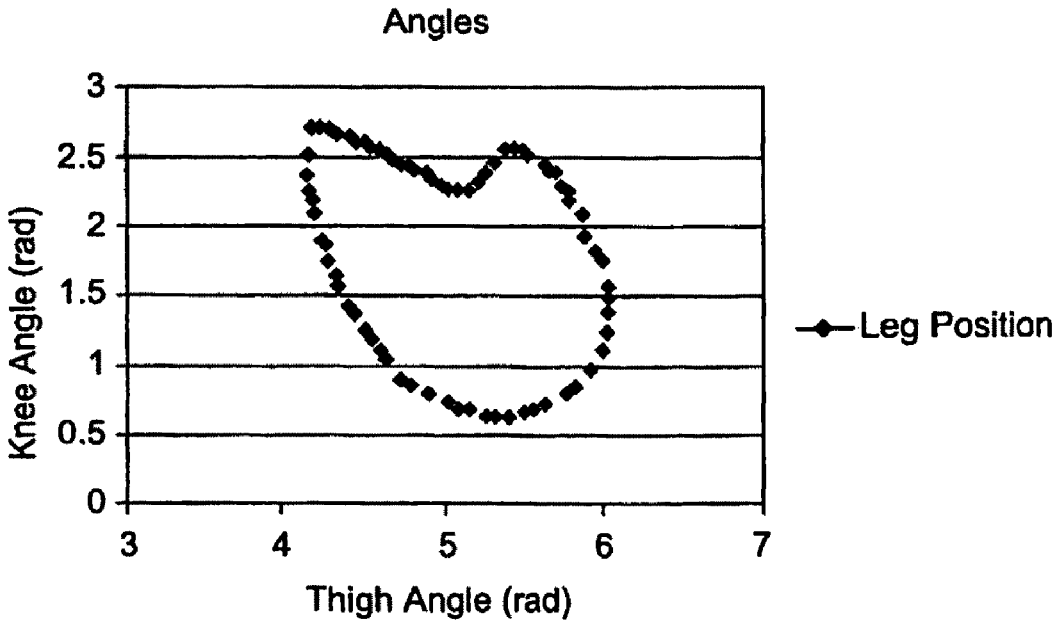
FIG. 8 shows revised data points generated from these data shown in FIG. 6.

Equations 3.1-3.3 are applied to give the position of the foot, in Cartesian coordinates, relative to a stationary upper body as shown in equations 3.4 and 3.5.

$$x=L*\cos(c)-M*\cos(a-b) \quad 3.4$$

$$y=L*\sin(c)-M*\sin(a-b) \quad 3.5$$

where c is the thigh angle relative to the horizontal at the hip joint given in FIG. 8, a is the knee angle given in FIG. 8 and b is $2\pi-c$. Equations 3.4 and 3.5 imply that the femur is rotating about the hip joint and the tibia is rotating about the knee joint as shown in the key of FIG. 6.

Figure 9:
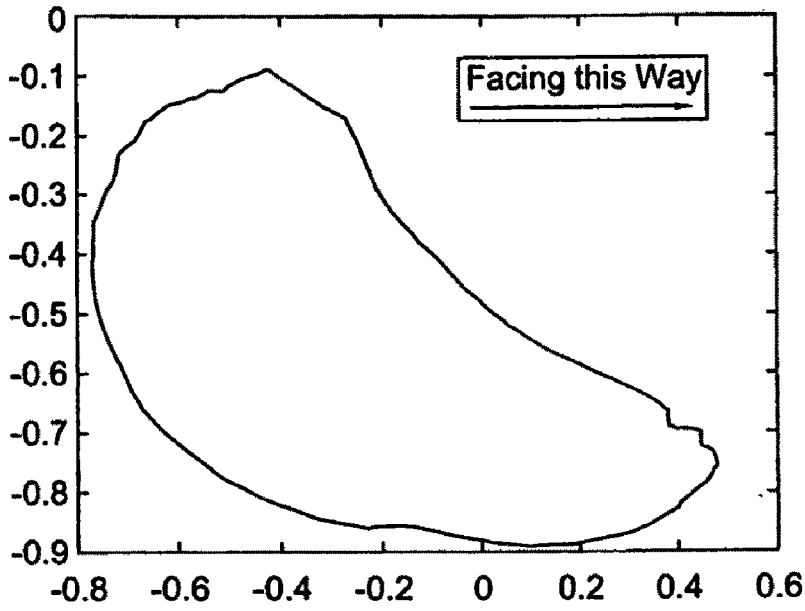
FIG. 9 is an initial plot of foot position using a developed Matlab program as well as data generated from equations 3.1-3.5 in the Specification.

The initial plotting of this relationship is also shown below in FIG. 9. One can easily notice the discontinuities of the movement by the irregular trajectories in the connection of these data points. Common sense tells us that these irregularities are not the actual motion of the leg, but the result of the error discussed earlier from the lack of first hand data. The curvilinear motion that describes the leg actually follows a relatively smooth path. These data were ultimately later modified slightly in a CAD software in order to obtain a final, smooth path.

A Matlab file was developed to manipulate the original data involved. This program required the raw data as well as the relationships established in equations 3.1-3.5. This program, when run, creates a plot for a given height value as well as display the x and y coordinates for each datum point. This program became useful later on when comparing the running gaits of several heights of individuals as well as modeling the relationships in a CAD program. In accordance with a preferred embodiment, all the x,y coordinates obtained earlier using Matlab were typed into the computer. The individual data points were then connected using an arcing function in the software. By editing these data points slightly, a smooth curvilinear path was created which is the basis for the path of the curvilinear track 14. From this curve the present curvilinear track 14 was created for providing the basis of movement for the leg in the present exercise apparatus 10. Empirical evidence has further been developed supporting the appropriateness of the track path utilized in accordance with the present invention.

Once the motion of the leg was established, the path of the curvilinear track 14 was modeled using the CAD software and the remainder of the exercise apparatus 10 was developed around the curvilinear track 14.

As briefly discussed above, it has been determined the best way to apply force to the user's leg in accordance with the present invention is to transfer the curvilinear motion of the leg as it moves about the curvilinear track 14 to a linear, horizontal motion where resistance may appropriately be applied via the weight stack 94. In order to appreciate the reasoning behind this large step in the development of the present exercise apparatus 10, an ample amount of background information is needed in the function of the leg and the muscles involved in the running process.

Figure 11:
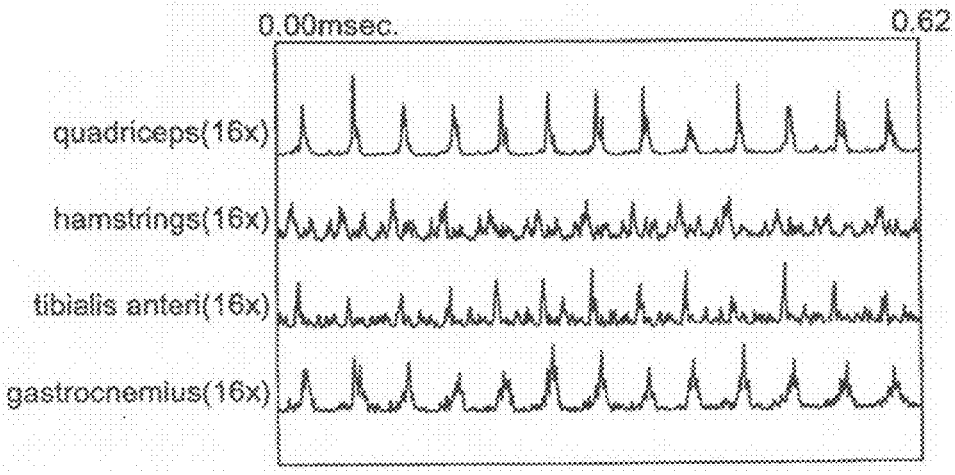
FIG. 11 shows typical EMG (electromyographic) results of muscles in the leg while running.

Shown in FIG. 11 are some typical EMG results of the firing of muscles while running. This information provided gives a qualitative look as to when the muscles fire concentrically and eccentrically during the running gait. This information tells us that the hamstring muscles work in two periodic fashions. One is to work in conjunction with the quadriceps to decelerate the tibia right before impacting the ground. This is its eccentric movement and its conjunction with the quadriceps is shown by the synchronization of the hamstring's EMG and the quadriceps' EMG. The other fashion in which the hamstring is used is in the stabilization of the leg while it is in contact with the ground and then most importantly, lifting the leg off the ground. This is its concentric movement. Both areas are extremely important and are highlighted in FIGS. 18 and 19 which are described above in greater detail.

Figure 12:
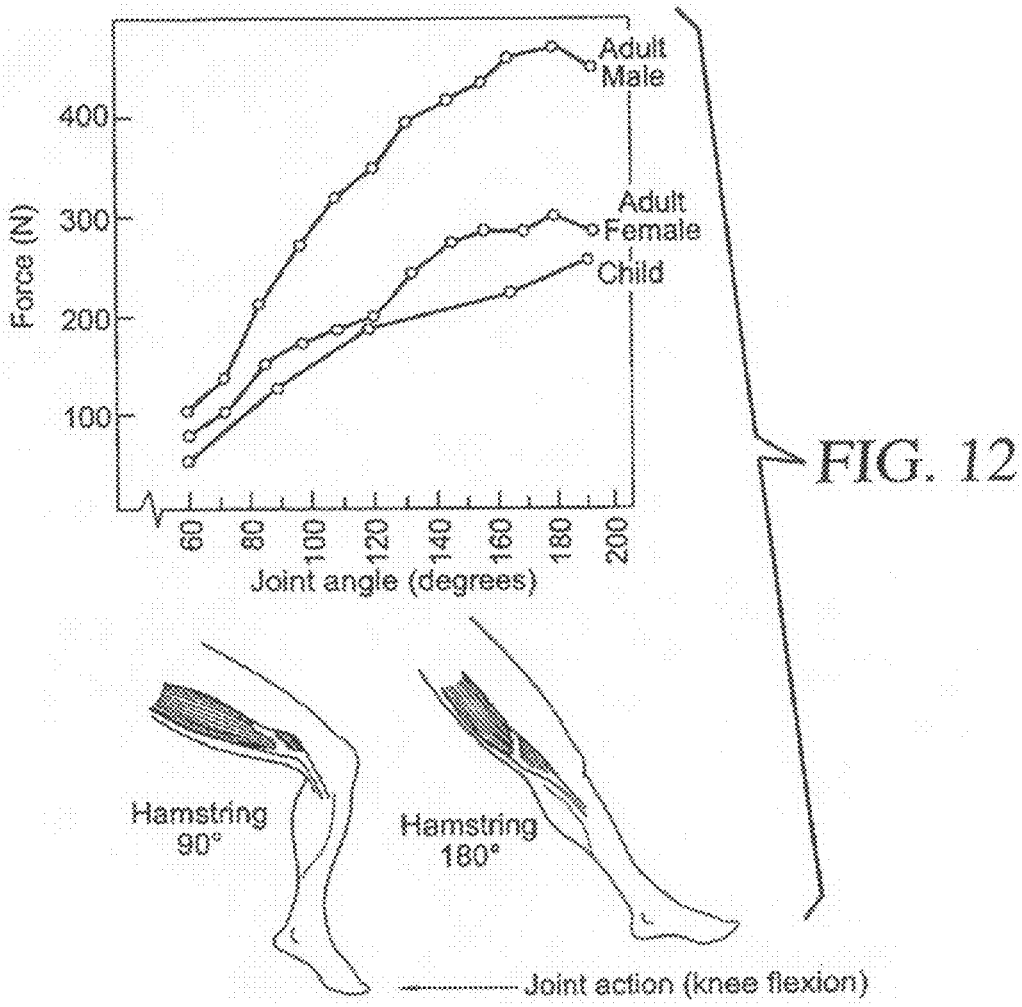
FIG. 12 shows a force curve for contraction of the hamstring.
Figure 13:
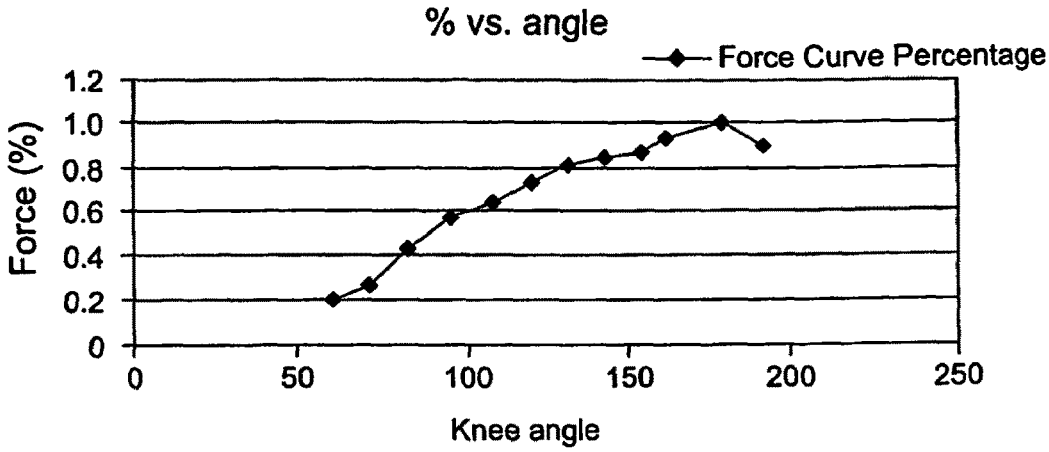
FIG. 13 shows a hamstring force curve in terms of percentage of maximum output force.

The quadriceps as well as the hamstring work in conjunction with each other and it is difficult to measure how much of each muscle is doing the work involved. There is, however, some highly disputed information about the forces involved in the concentric motion of the hamstring due to its isolation during this motion. Force curves tell us what the muscle is capable of lifting at a certain angle during its concentric and eccentric phase. An example of a force curve for the hamstring of an individual can be seen below. It should be noted that the units involved are Newtons. This tells us that this is highly individual and a more general scale is needed for our purposes. In developing the present exercise apparatus, a curve that could tell proportionately how much weight could be lifted when the leg was at a certain angle when compared to another angle was desired. To do this, these data in FIG. 12 were transformed so the scale on the y-axis was a percentage ranging from 0 to 100% in terms of the force capable of lifting. This is shown in FIG. 13. From this information above, one can see the hamstring is capable of lifting more weight when it is contracting at an extended angle rather than when it is almost fully contracted. A way that this curve is utilized in practice is in weight machines. A cam is used to compensate for the weaker portions of the hamstring movement creating an isotonic contraction. This data and method of implementation makes sense, but as mentioned earlier is widely disputed. Many experts claim that the use of the cam shows no significant improvement in muscle strength when compared to that of a movement that doesn't utilize this information.

Figure 14:
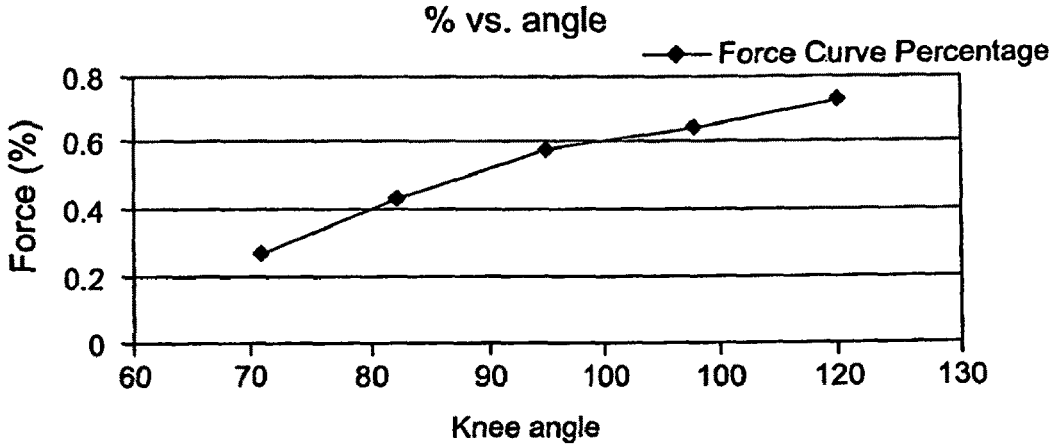
FIG. 14 shows a force curve for the limited range of the leg during a sprint.

FIG. 14 indicates that that the force needed when the knee angle is at its slightest degree is approximately half of that when it is fully extended. This can be partially confirmed by observations of several leg machines available on the current market. The cam's radius on these machines ranged from 6 inches at a full extension, to 12 inches at the end of a concentric curl. This would provide a gradual change of resistance from 200% to 100% having an ideal felt resistance of 100% during the entire motion (100% of the resistance being a constant force at 6 inches from center).

Linear Regression Fit of Data

Figure 15:
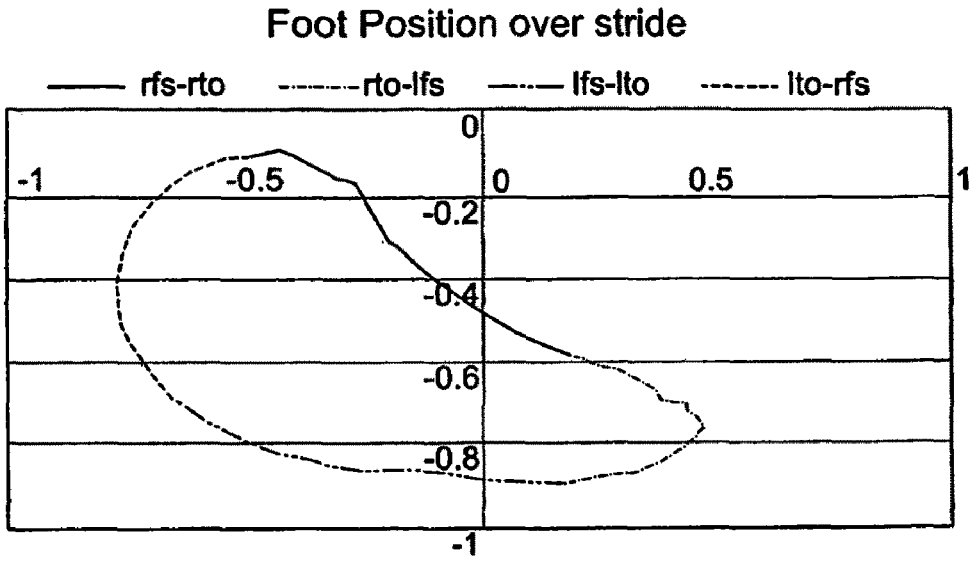
FIG. 15 shows foot position as a function of stride, where rsf=right foot strike, rto=right toe off, lfs=left foot strike and lto=left toe off; wherein rfs-rto (that is, the movement from rfs to rto) can also be termed "mid-swing phase", rto-lfs (that is, the movement from rto to lfs) can be termed "late swing/foot strike", lfs-lto (that is, the movement from lfs to lto) can be termed "stance phase" and lto-rfs (that is, the movement from lto to rfs) can be termed "early swing phase". This data is generated based upon the information presented in FIG. 16.
Figure 16:
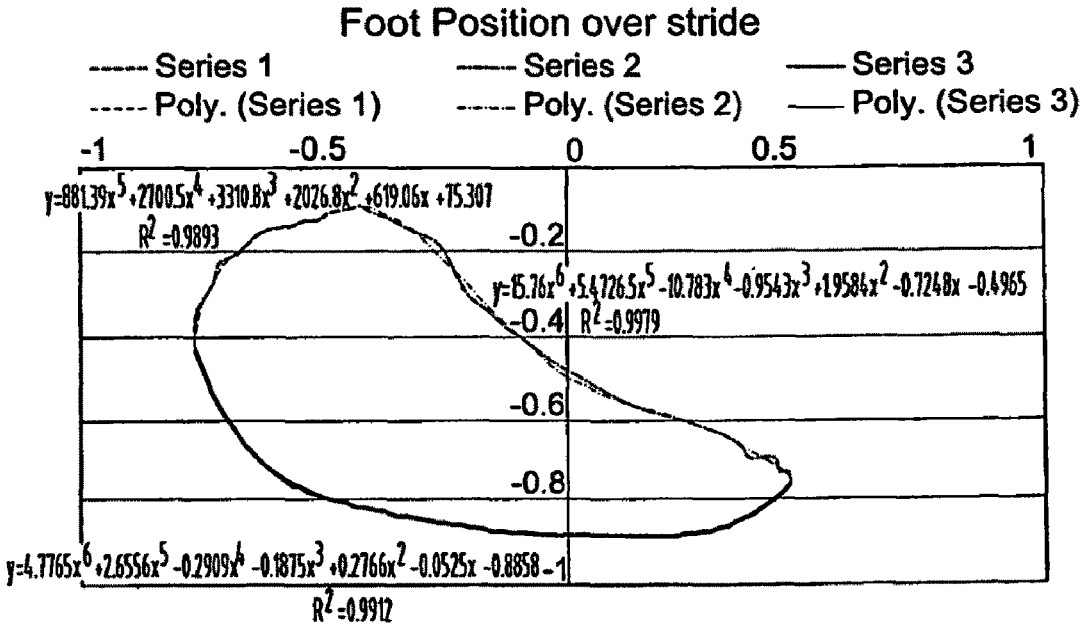
FIG. 16 shows Cartesian equations describing foot position.

When transferring resistance to the leg, the equations describing the tangents to the path that the leg follows are of most importance. These equations are obtained by taking the derivative of the equations that describes the motion of the leg. Mathematical software can model the path of the leg and produce a Cartesian equation that fits the motion of the leg quite superbly using linear regression lines. The equations describing the path as well as their plots are shown in FIGS. 15 and 16. FIG. 15 can be used as a reference to the particular segments in the sprinting gait; that is, the mid-swing phase, late swing/foot strike, stance phase and early swing phase as shown and described with reference to FIG. 15.

Figure 17:
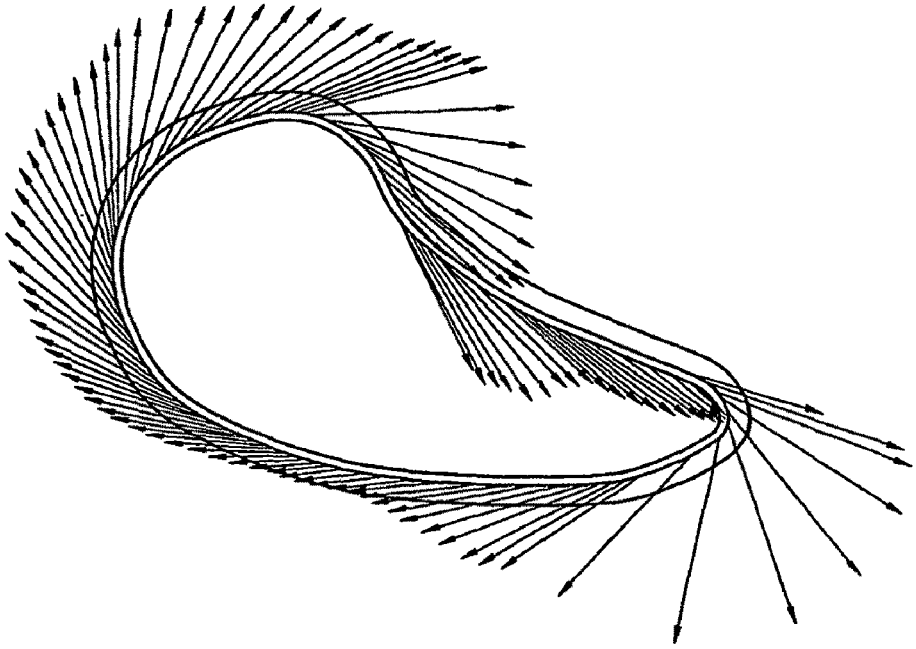
FIG. 17 shows an array of vectors tangent to the footpath during entire run gait. The arrows represent vector forces applied during the gait cycle at the foot.

In accordance with the present disclosure, Cartesian coordinates are used because, even though the motion of the leg is periodic, it can be easily broken up into smaller sections that would be easier to analyze and modify later in the development of the machine. By finding the tangents to the path along all points of the curve one can then see what forces are needed to produce a desired reaction in the leg. The equations if needed are available, but once again it was decided to use the software available in CAD to demonstrate these tangents. This is shown in FIG. 17. This plot provides a very descriptive, qualitative assessment of the tangents to the track path which will later be used.

Calculation of Force

Figure 22:
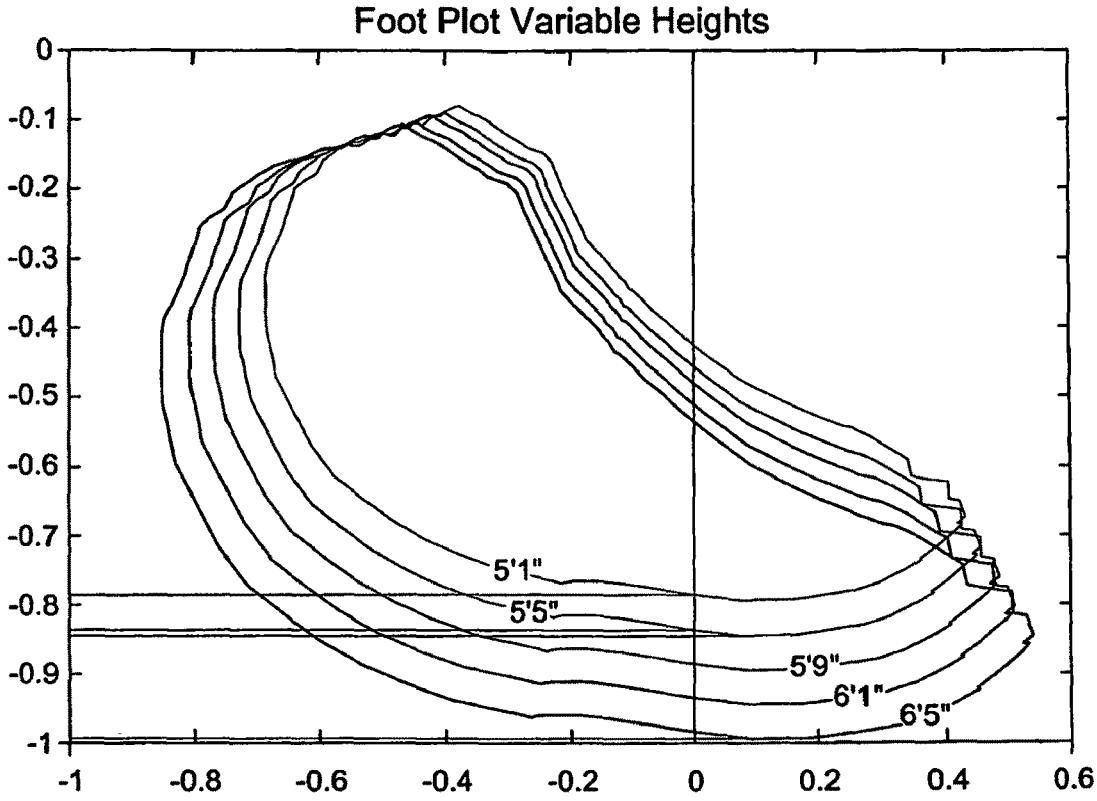
FIG. 22 shows the footpaths for individuals of different heights where the hip joint is located in the same location for each curve.
Figure 23:
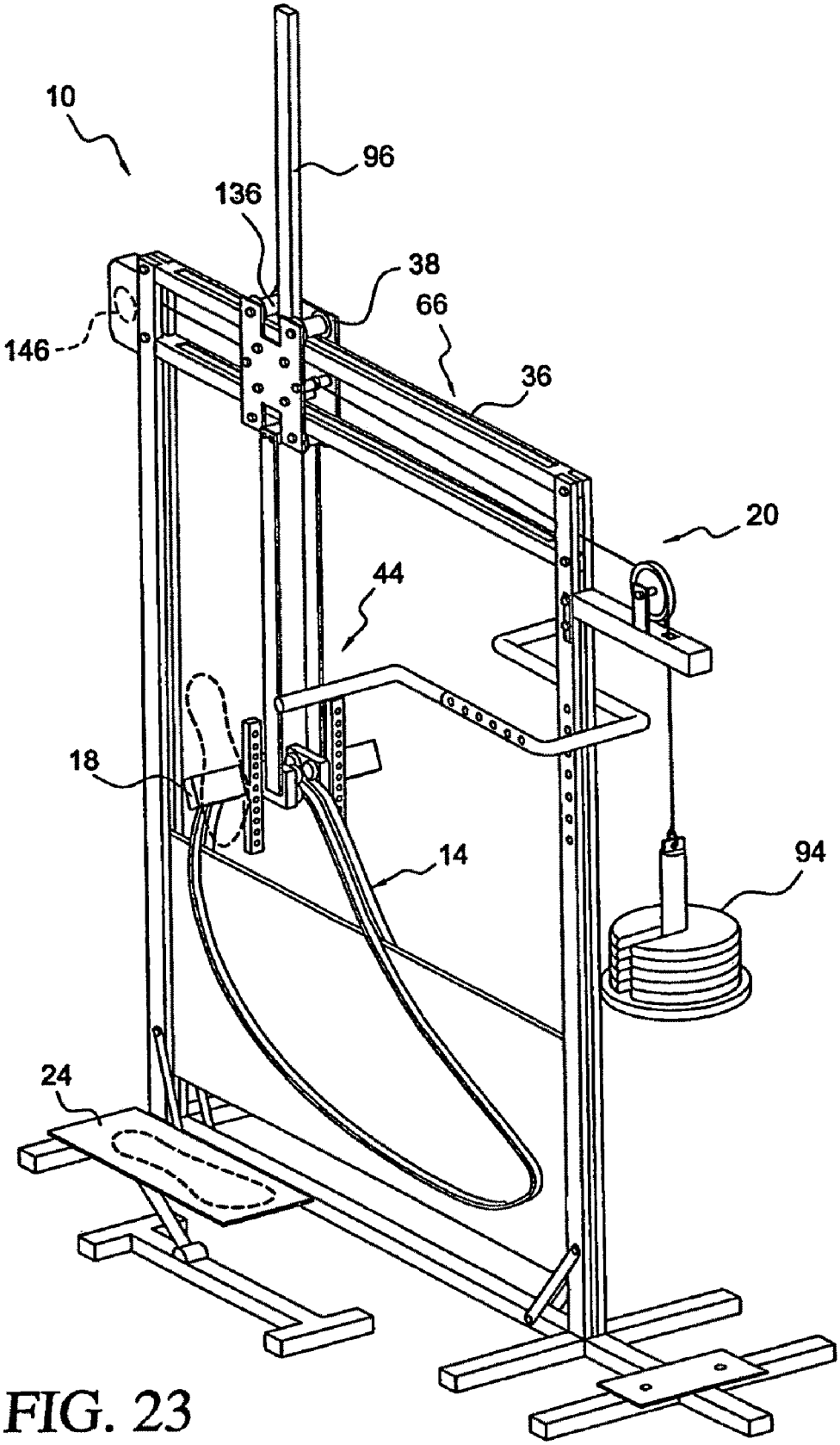
FIGS. 23 to 28 show the various steps associated with utilization of the present exercise apparatus.
Figure 24:
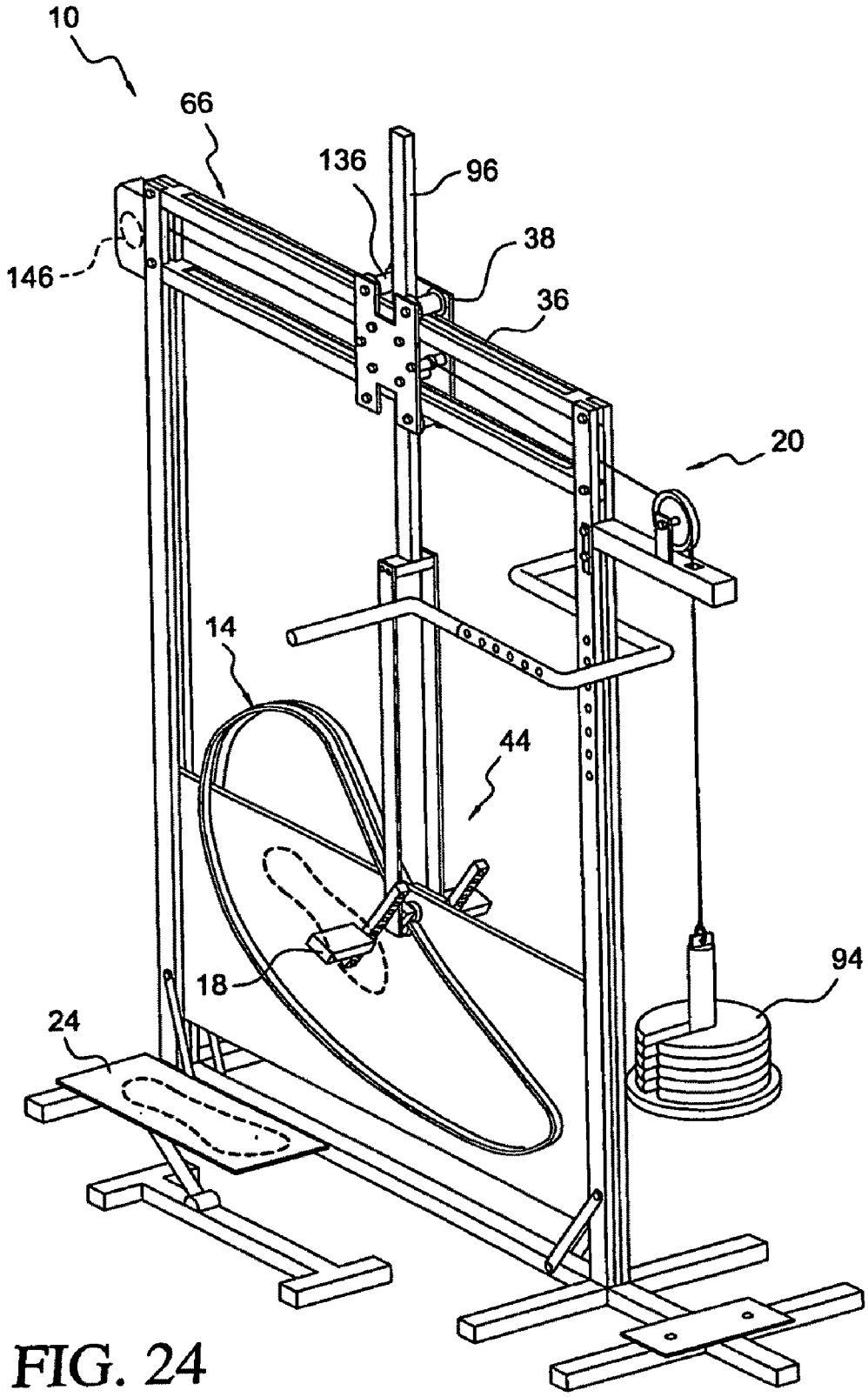
Figure 25:
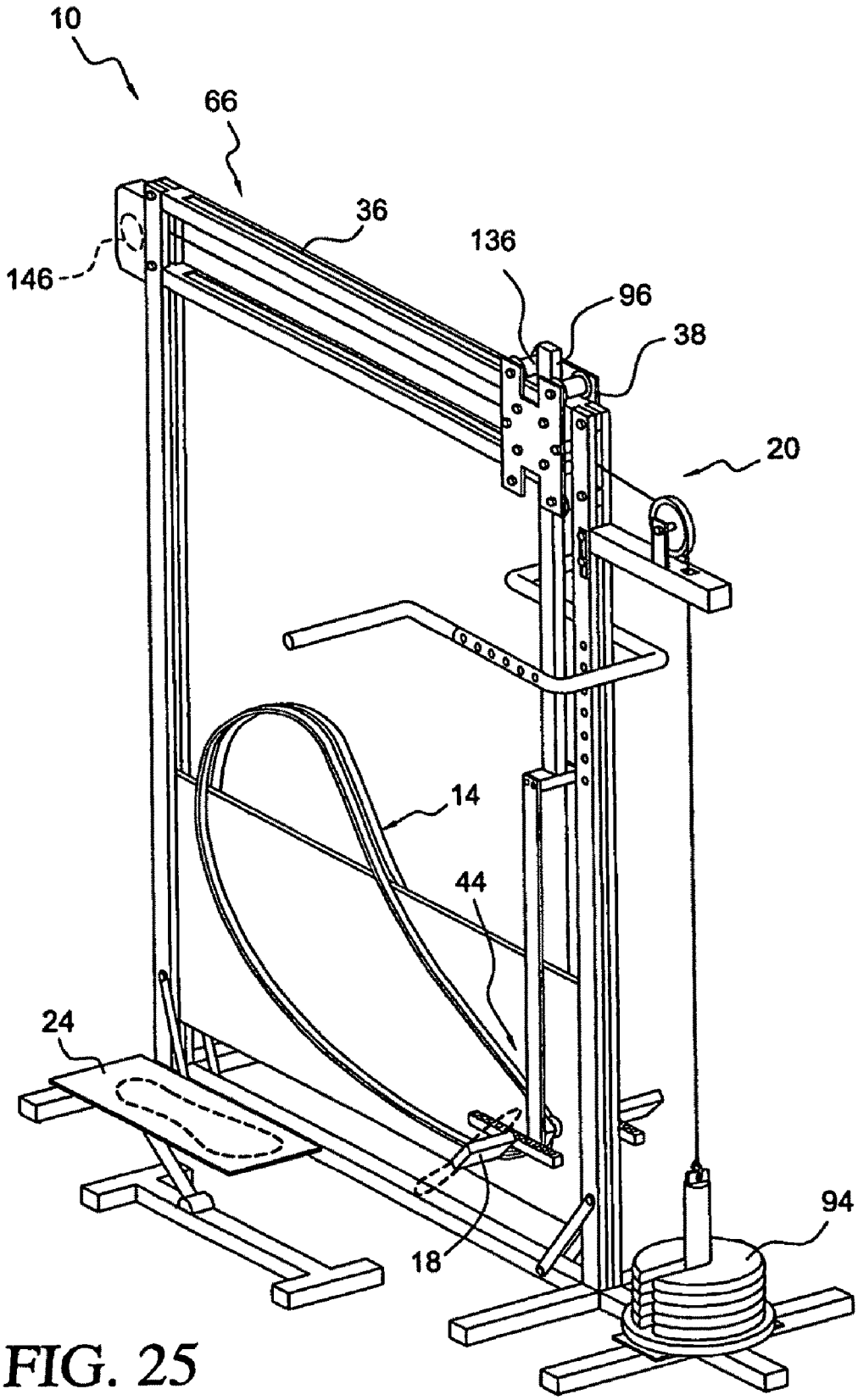
Figure 26:
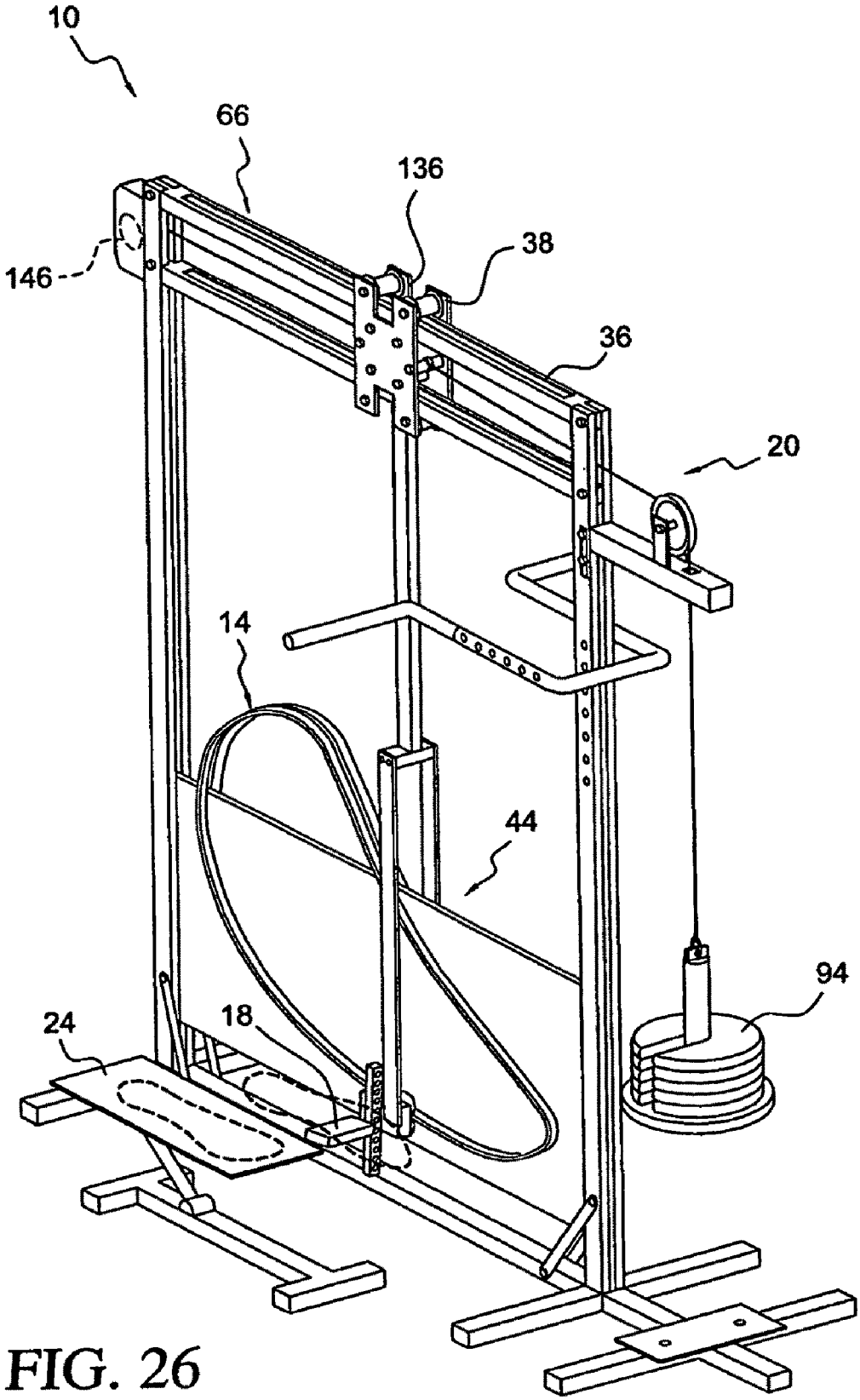
Figure 27:
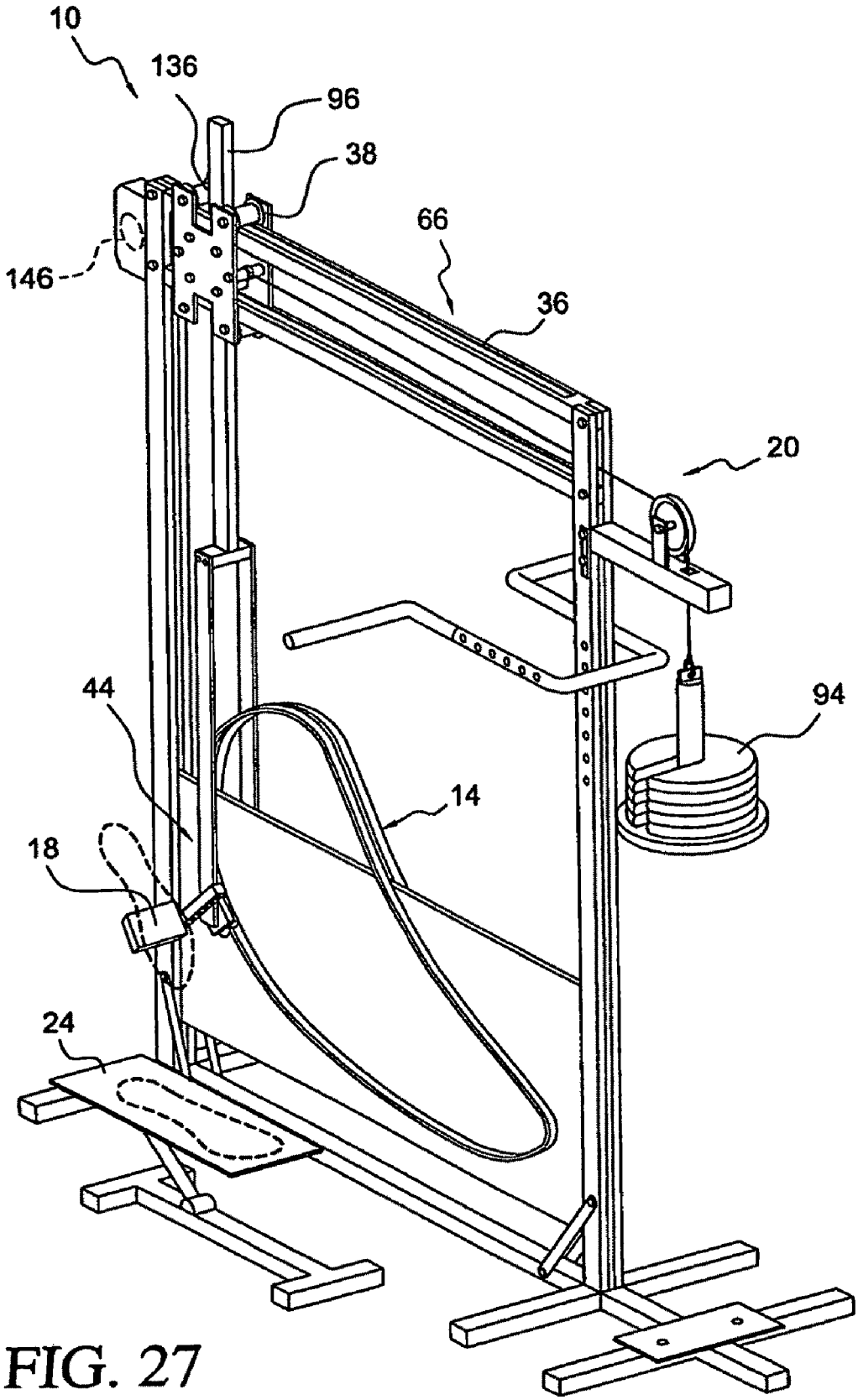
Figure 28:
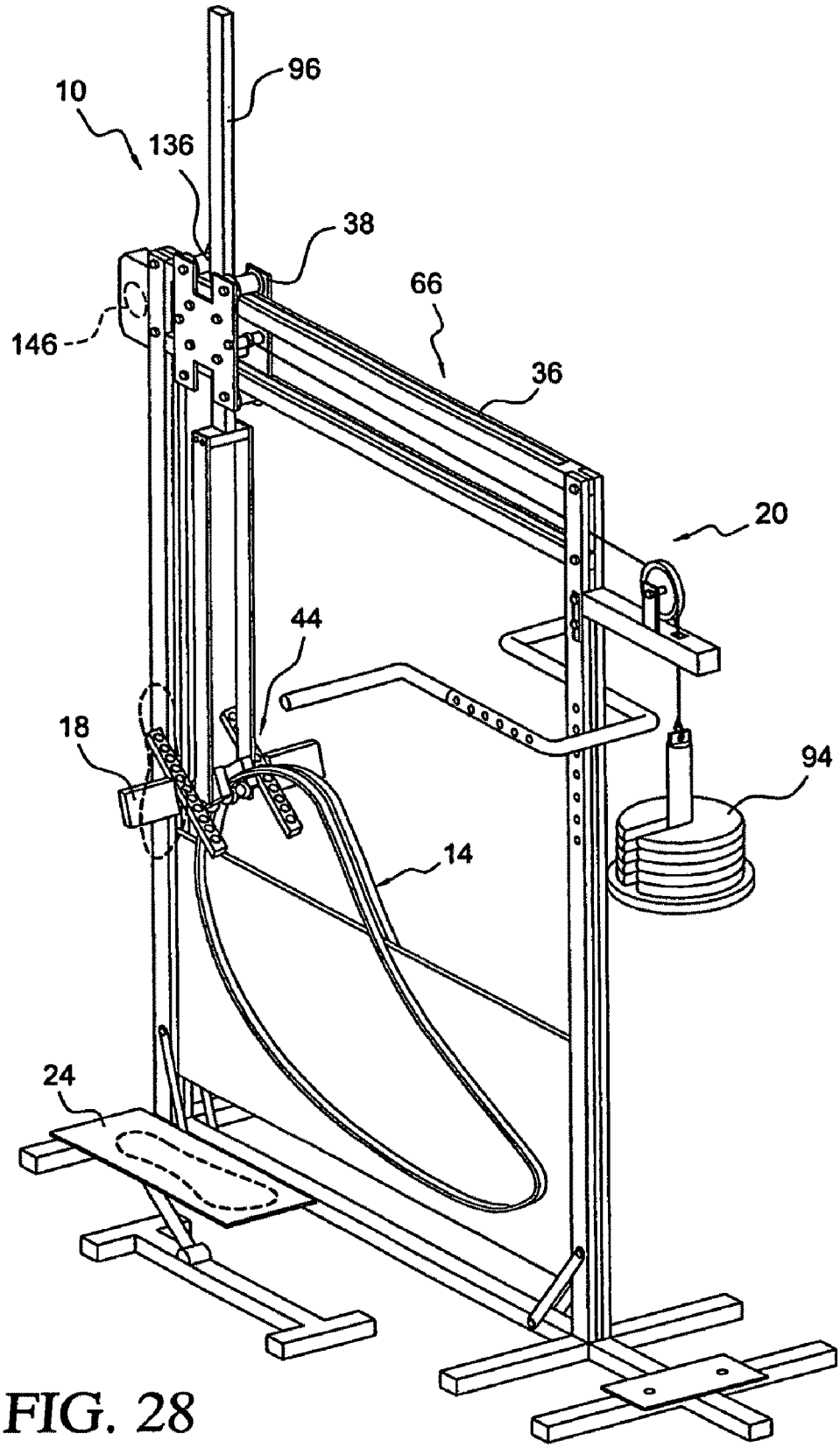

The present exercise apparatus 10 may need to be designed to accommodate changes to the forces involved. For example, instead of using a pulley, which is used in accordance with a preferred embodiment of the present invention as described herein, it is contemplated a cam might be needed instead. Since many assumptions have been made as to what forces will be required to properly exercise the hamstring, it has been deemed inappropriate to describe the forces needed with an exact equation such as those found in FIG. 16. In terms of the tangents to the path, this could be modeled via ProE software and was done as shown in FIG. 17. FIG. 17 shows the tangents to the path at certain regions of the running gait. This gives a qualitative view of the components of forces involved in the motion of the leg. It is contemplated, a cam can later be developed and fitted to the exercise apparatus if experiments of the exercise apparatus and observations made by users of the exercise apparatus indicate that a pulley is not sufficient in delivering the correct force. The equations describing the leg motion can then be used as a tool to interpolate the proper resistance through experimentation. The proper sequence of forces to be applied to the linear carriage 38 and translated to the foot is solely based on the individual user with the goal of the individual's neuromuscular activity being similar to that shown in FIG. 11 thus replicating forces typically seen during running. As those skilled in the art will certainly appreciate, sequences are not limited to replicating the neuromuscular activity shown in FIG. 11 and variations may be made thereto without departing from the spirit of the present invention. Those skilled in the art will appreciate the forces generated by the resistive device will create forces at the foot that will translate to the leg. The EMG signals are indirect methods of measuring the sequence of forces and match them up with the running gait so if the person ran and the person got on the machine, their EMG signal would be similar. Thus the machine generated forces seen in running. As discussed above, the present exercise apparatus needs to cater to a wide range of individuals. As mentioned earlier, this includes a large height range to accommodate. Using the Matlab program mentioned earlier, several paths are plotted for different heights of individuals. These are shown on the next page in FIG. 22.

These plots are all centered about the same stationary hip joint. In actuality, as the individuals' heights differed from that of the 5 ft. 9 inch ideal path so would the hip joint that the leg motion is being modeled around. A more accurate plot of this data would shift the hip joint up or down vertically with respect to the original hip joint. This would create a pattern that shows that a taller person as well a shorter person has a foot trajectory that is offset to the original. To accommodate for this, and as discussed above, an adjust mechanism, generally in the form of adjustment bars 88, 90 and support blocks 93, 95, for the foot engaging supports 16, 18 (or foot pedals) has been implemented in accordance with the present invention. This adjustment mechanism offers a wide range of adjustments just like that of the heights of people. The pedal 50 connecting the foot to the exercise apparatus 10 is able to rotate freely relative to the adjustment bar 88, 90 as shown in FIG. 3.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. An exercise apparatus comprising:

a support frame upon which is mounted a track, the track substantially conforming to a runner's footpath while striding;

a first foot engaging support secured to the track for movement thereabout while exercising;

a resistance assembly secured to the first foot engaging support for applying resistance as a user moves the first foot engaging support about the track; and wherein the shape of the track is approximately formed in accordance with the formulas $x=L*\cos(c)-M*\cos(a-b)$ and $y=L*\sin(c)-M*\sin(a-b)$, where c is thigh angle relative to a horizontal at a hip joint, a is knee angle, b is $2\pi-c$, L is femur length, and M is tibia length plus shoe sole thickness.

2. The exercise apparatus according to claim 1, further including a first static foot platform positioned adjacent a first side of the track.

3. The exercise apparatus according to claim 1, further including a second foot engaging support.

4. The exercise apparatus according to claim 3, wherein the first foot engaging support is on a first side of the track and the second foot engaging support is on a second side of the track.

5. The exercise apparatus according to claim 4, further including a first static foot platform positioned adjacent the first side of the track and a second foot platform positioned adjacent the second side of the track.

6. The exercise apparatus according to claim 1, wherein the resistance assembly further includes an electromagnetic resistance assembly secured to the first foot engaging support.

7. The exercise apparatus according to claim 1, wherein the resistance assembly is an electromagnetic resistance assembly secured to the first foot engaging support via a belt.

8. The exercise apparatus according to claim 1, wherein the resistance varies as the first foot engaging support moves about the track.

9. An exercise apparatus comprising:

a support frame upon which is mounted a track, the track substantially conforming to a runner's footpath while striding;

a first foot engaging support secured to the track for movement thereabout while exercising;

a resistance assembly secured to the first foot engaging support for applying resistance as a user moves the first foot engaging support about the track; and wherein the shape of track is approximately formed in accordance with the formulas $x=L*\cos(c)-M*\cos(a-b)$ and $y=L*\sin(c)-M*\sin(a-b)$, where c is a proximal limb segment angle relative to a horizontal, a is a joint angle between an adjacent distal limb segment and the proximal limb segment , b is $2\pi-c$, L is a length of the proximal limb segment, and M is a length of the distal segment plus additional distance to the limb engagement point.

10. An exercise apparatus comprising:

a support frame upon which is mounted a first limb engagement support for guiding a limb about a predetermined curvilinear path conforming to a user's limb movement while exercising; and a resistance assembly secured to the first limb engaging support for applying resistance as a user moves the first limb engaging support about the curvilinear path; and wherein the shape of the curvilinear path is approximately formed in accordance with the formulas $x=L*\cos(c)-M*\cos(a-b)$ and $y=L*\sin(c)-M*\sin(a-b)$ , where c is thigh angle relative to a horizontal at a hip joint, a is knee angle, b is $2\pi-c$, L is femur length, and M is tibia length plus shoe sole thickness.

11. The exercise apparatus according to claim 10, further including a first static limb platform positioned adjacent a first side of the curvilinear path.

12. The exercise apparatus according to claim 10, further including a second limb engaging support.

13. The exercise apparatus according to claim 12, wherein the first limb engaging support is on a first side of the curvilinear path and the second limb engaging support is on a second side of the curvilinear path.

14. The exercise apparatus according to claim 13, further including a first static limb platform positioned adjacent the first side of the curvilinear path and a second limb platform positioned adjacent the second side of the curvilinear path.

15. The exercise apparatus according to claim 10, wherein the resistance assembly further includes an electromagnetic resistance assembly secured to the first limb engaging support.

16. The exercise apparatus according to claim 10, wherein the resistance assembly is an electromagnetic resistance assembly secured to the first limb engaging support via a belt.

17. The exercise apparatus according to claim 10, wherein the resistance varies as the first limb engaging support moves about the curvilinear path.

18. An exercise apparatus comprising:

a support frame upon which is mounted a first limb engagement support for guiding a limb about a predetermined curvilinear path conforming to a user's limb movement while exercising; and a resistance assembly secured to the first limb engaging support for applying resistance as a user moves the first limb engaging support about the curvilinear path; and wherein the shape of the curvilinear path is approximately formed in accordance with the formulas $x=L*\cos(c)-M*\cos(a-b)$ and $y=L*\sin(c)-M*\sin(a-b)$, where c is a proximal limb segment angle relative to a horizontal, a is a joint angle between an adjacent distal limb segment and the proximal limb segment , b is $2\pi-c$, L is a length of the proximal limb segment, and M is a length of the distal segment plus additional distance to the limb engagement point.

* * * * *

UNITED STATES PATENT AND TRADEMARK OFFICE

CERTIFICATE OF CORRECTION

PATENT NO. : 8,043,195 B2
APPLICATION NO. : 12/801044
DATED : October 25, 2011
INVENTOR(S) : Thomas Cunningham It is certified that error appears in the above-identified patent and that said Letters Patent is hereby corrected as shown below:

Title Pg, Item (73) Assignee:
"Atlanta, GA (US)" should be changed to --Lexington, KY (US)--.

Signed and Sealed this
Tenth Day of January, 2012

David J. Kappos

David J. Kappos
*Director of the United States Patent and Trademark Office*